US009377744B2

(12) United States Patent
Yoshioka

(10) Patent No.: US 9,377,744 B2
(45) Date of Patent: Jun. 28, 2016

(54) TRANSFER DEVICE AND IMAGE FORMING APPARATUS WITH ELECTRICAL POWER SUPPLY

(71) Applicant: FUJI XEROX CO., LTD., Tokyo (JP)

(72) Inventor: Tomoaki Yoshioka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/218,372

(22) Filed: Mar. 18, 2014

(65) Prior Publication Data

US 2015/0030342 A1 Jan. 29, 2015

(30) Foreign Application Priority Data

Jul. 25, 2013 (JP) ..... 2013-155060

(51) Int. Cl.
*G03G 15/16* (2006.01)
*G03G 15/00* (2006.01)

(52) U.S. Cl.
CPC ..... *G03G 15/80* (2013.01); *G03G 15/1605* (2013.01); *G03G 15/1675* (2013.01)

(58) Field of Classification Search
CPC .... G03G 15/16; G03G 15/1605; G03G 15/80
USPC ..... 399/302, 66
See application file for complete search history.

(56) References Cited

U.S. PATENT DOCUMENTS

| | | | | |
|---|---|---|---|---|
| 6,324,359 | B1 * | 11/2001 | Nakane | 399/66 |
| 6,487,380 | B1 * | 11/2002 | Ito | 399/66 |
| 2012/0045231 | A1 | 2/2012 | Ogino et al. | |
| 2012/0315058 | A1 * | 12/2012 | Shimizu | G03G 15/1645 399/66 |
| 2013/0142531 | A1 * | 6/2013 | Sugimoto et al. | 399/66 |
| 2013/0308968 | A1 * | 11/2013 | Tanaka et al. | 399/44 |

FOREIGN PATENT DOCUMENTS

| | | |
|---|---|---|
| JP | A-2012-042827 | 3/2012 |
| JP | A-2012-118107 | 6/2012 |

* cited by examiner

*Primary Examiner* — Quana M Grainger
(74) *Attorney, Agent, or Firm* — Oliff PLC

(57) ABSTRACT

A transfer device includes a first-transfer power supply that includes a direct-current power supply and an alternating-current power supply, and a first-transfer member that transfers a toner image formed on an outer peripheral surface of an image carrier to a receiving member from which the toner image is transferred to a medium. The first-transfer member transfers the toner image by receiving a voltage from the first-transfer power supply.

19 Claims, 20 Drawing Sheets

FIG. 13

| WORKING EXAMPLE/ COMPARATIVE EXAMPLE | FIG. # | CONDITIONS FOR FIRST TRANSFER | | | CONDITIONS FOR SECOND TRANSFER | | | NOTES |
|---|---|---|---|---|---|---|---|---|
| | | Vdc (kV.) | Vpp (kV.) | f (kHz) | Vdc (kV.) | Vpp (kV.) | f (kHz) | |
| WORKING EXAMPLE 1 | FIG. 16 | 0.3 | 1.5 | 1.0 | −0.5 | 1.0 TO 1.5 | 0.1 TO 1.0 | CORRESPONDING TO SECOND EXEMPLARY EMBODIMENT. |
| WORKING EXAMPLE 2 | FIG. 17 | 0.3 | 1.5 | 1.0 | −1.2 | — | — | CORRESPONDING TO FIRST EXEMPLARY EMBODIMENT. ALTERNATING-CURRENT VOLTAGE IS APPLIED TO ALL FIRST-TRANSFER ROLLERS. |
| WORKING EXAMPLE 3 | FIG. 17 | 0.3 | 1.5 | 1.0 | −1.2 | — | — | CORRESPONDING TO FOURTH EXEMPLARY EMBODIMENT. ALTERNATING-CURRENT VOLTAGE IS APPLIED TO MOST DOWNSTREAM ONE OF FIRST-TRANSFER ROLLERS. DIRECT-CURRENT VOLTAGE IS APPLIED TO THE OTHER FIRST-TRANSFER ROLLERS. |
| WORKING EXAMPLE 4 | FIG. 19 | 1.8 | — | — | −0.5 | 1.0 TO 1.5 | 0.1 TO 1.0 | CORRESPONDING TO FIFTH EXEMPLARY EMBODIMENT. |
| WORKING EXAMPLE 5 | FIG. 20 | 1.8 | — | — | −0.5 | 1.0 TO 1.5 | 0.1 TO 1.0 | CORRESPONDING TO MODIFICATION OF FIFTH EXEMPLARY EMBODIMENT. |
| COMPARATIVE EXAMPLE 1 | FIG. 17 | 2.0 | — | — | −1.8 | — | — | |
| COMPARATIVE EXAMPLE 2 | FIG. 14B | 2.0 | — | — | −0.5 | 3.5 | 2.0 | |
| COMPARATIVE EXAMPLE 3 | FIG. 15 | 2.0 | — | — | −0.5 | 1.0 TO 4.0 | 0.5 TO 3.0 | |
| COMPARATIVE EXAMPLE 4 | FIG. 18 | 1.8 | — | — | −0.5 | 1.0 TO 4.0 | 0.5 TO 3.0 | |

FIG. 15A

| | TONER CHARGE AMOUNT (μC/g) | 10 | | | | 20 | | | | 30 | | | |
|---|---|---|---|---|---|---|---|---|---|---|---|---|---|
| | FREQUENCY (kHz) | 0.5 | 1 | 2 | 3 | 0.5 | 1 | 2 | 3 | 0.5 | 1 | 2 | 3 |
| Vpp (kV) | 1.0 | G6 | G5 | G3 | G2 | G6 | G6 | G4 | G3 | G6 | G6 | G4 | G3 |
| | 2.0 | G6 | G5 | G3 | G2 | G6 | G5 | G3 | G2 | G6 | G6 | G4 | G3 |
| | 3.0 | G6 | G4 | G2 | G2 | G6 | G5 | G2 | G2 | G6 | G5 | G3 | G2 |
| | 4.0 | G6 | G4 | G2 | G2 | G6 | G4 | G2 | G2 | G6 | G5 | G3 | G2 |

FIG. 15B

| | TONER CHARGE AMOUNT (μC/g) | 10 | | | | 20 | | | | 30 | | | |
|---|---|---|---|---|---|---|---|---|---|---|---|---|---|
| | FREQUENCY (kHz) | 0.5 | 1 | 2 | 3 | 0.5 | 1 | 2 | 3 | 0.5 | 1 | 2 | 3 |
| Vpp (kV) | 1.0 | ○ | ○ | × | × | ○ | ○ | × | × | ○ | △ | × | × |
| | 2.0 | ○ | △ | × | × | △ | △ | × | × | △ | △ | × | × |
| | 3.0 | △ | × | × | × | × | × | × | × | × | × | × | × |
| | 4.0 | × | × | × | × | × | × | × | × | × | × | × | × |

○ : NO SCATTERING OF TONER

△ : SLIGHT SCATTERING OF TONER

× : APPARENT SCATTERING OF TONER

FIG. 16A

| | TONER CHARGE AMOUNT (μC/g) | 10 | | | | 20 | | | | 30 | | | |
|---|---|---|---|---|---|---|---|---|---|---|---|---|---|
| | FREQUENCY (kHz) | 0.1 | 0.3 | 0.5 | 1 | 0.1 | 0.3 | 0.5 | 1 | 0.1 | 0.3 | 0.5 | 1 |
| Vpp (kV) | 1.0 | G3 | G2 | G1 | G1 | G3 | G3 | G1 | G1 | G3 | G3 | G1 | G1 |
| | 1.5 | G3 | G2 | G1 | G0 | G3 | G3 | G1 | G0 | G3 | G3 | G1 | G1 |

FIG. 16B

| | TONER CHARGE AMOUNT (μC/g) | 10 | | | | 20 | | | | 30 | | | |
|---|---|---|---|---|---|---|---|---|---|---|---|---|---|
| | FREQUENCY (kHz) | 0.1 | 0.3 | 0.5 | 1 | 0.1 | 0.3 | 0.5 | 1 | 0.1 | 0.3 | 0.5 | 1 |
| Vpp (kV) | 1.0 | ○ | ○ | ○ | ○ | ○ | ○ | ○ | ○ | ○ | ○ | ○ | ○ |
| | 1.5 | ○ | ○ | ○ | ○ | ○ | ○ | ○ | ○ | ○ | ○ | ○ | △ |

○ : NO SCATTERING OF TONER
△ : SLIGHT SCATTERING OF TONER
× : APPARENT SCATTERING OF TONER

FIG. 18A

| | TONER CHARGE AMOUNT (μC/g) | 10 | | | | 20 | | | | 30 | | | |
|---|---|---|---|---|---|---|---|---|---|---|---|---|---|
| | FREQUENCY (kHz) | 0.5 | 1 | 2 | 3 | 0.5 | 1 | 2 | 3 | 0.5 | 1 | 2 | 3 |
| Vpp (kV) | 1.0 | G6 | G5 | G3 | G2 | G6 | G6 | G4 | G3 | G6 | G6 | G4 | G3 |
| | 2.0 | G6 | G5 | G3 | G2 | G6 | G5 | G3 | G2 | G6 | G6 | G4 | G3 |
| | 3.0 | G6 | G4 | G2 | G2 | G6 | G5 | G2 | G2 | G6 | G5 | G3 | G2 |
| | 4.0 | G6 | G4 | G2 | G2 | G6 | G4 | G2 | G2 | G6 | G5 | G3 | G2 |

FIG. 18B

| | TONER CHARGE AMOUNT (μC/g) | 10 | | | | 20 | | | | 30 | | | |
|---|---|---|---|---|---|---|---|---|---|---|---|---|---|
| | FREQUENCY (kHz) | 0.5 | 1 | 2 | 3 | 0.5 | 1 | 2 | 3 | 0.5 | 1 | 2 | 3 |
| Vpp (kV) | 1.0 | ○ | ○ | × | × | ○ | ○ | × | × | ○ | △ | × | × |
| | 2.0 | ○ | △ | × | × | △ | △ | × | × | △ | △ | × | × |
| | 3.0 | △ | × | × | × | × | × | × | × | × | × | × | × |
| | 4.0 | × | × | × | × | × | × | × | × | × | × | × | × |

○ : NO SCATTERING OF TONER

△ : SLIGHT SCATTERING OF TONER

× : APPARENT SCATTERING OF TONER

FIG. 19A

| | TONER CHARGE AMOUNT (μC/g) | 10 | | | | 20 | | | | 30 | | | |
|---|---|---|---|---|---|---|---|---|---|---|---|---|---|
| | FREQUENCY (kHz) | 0.1 | 0.3 | 0.5 | 1 | 0.1 | 0.3 | 0.5 | 1 | 0.1 | 0.3 | 0.5 | 1 |
| Vpp (kV) | 1.0 | G3 | G2 | G1 | G1 | G3 | G3 | G1 | G1 | G3 | G3 | G1 | G1 |
| | 1.5 | G3 | G2 | G1 | G0 | G3 | G3 | G1 | G0 | G3 | G3 | G1 | G1 |

FIG. 19B

| | TONER CHARGE AMOUNT (μC/g) | 10 | | | | 20 | | | | 30 | | | |
|---|---|---|---|---|---|---|---|---|---|---|---|---|---|
| | FREQUENCY (kHz) | 0.1 | 0.3 | 0.5 | 1 | 0.1 | 0.3 | 0.5 | 1 | 0.1 | 0.3 | 0.5 | 1 |
| Vpp (kV) | 1.0 | ○ | ○ | ○ | ○ | ○ | ○ | ○ | ○ | ○ | ○ | ○ | ○ |
| | 1.5 | ○ | ○ | ○ | ○ | ○ | ○ | ○ | ○ | ○ | ○ | ○ | △ |

○ : NO SCATTERING OF TONER
△ : SLIGHT SCATTERING OF TONER
× : APPARENT SCATTERING OF TONER

FIG. 20A

| | TONER CHARGE AMOUNT (μC/g) | 10 | | | | 20 | | | | 30 | | | |
|---|---|---|---|---|---|---|---|---|---|---|---|---|---|
| | FREQUENCY (kHz) | 0.1 | 0.3 | 0.5 | 1 | 0.1 | 0.3 | 0.5 | 1 | 0.1 | 0.3 | 0.5 | 1 |
| Vpp (kV) | 1.0 | G3 | G2 | G1 | G1 | G3 | G3 | G1 | G1 | G3 | G3 | G1 | G1 |
| | 1.5 | G3 | G2 | G1 | G0 | G3 | G3 | G1 | G0 | G3 | G3 | G1 | G1 |

FIG. 20B

| | TONER CHARGE AMOUNT (μC/g) | 10 | | | | 20 | | | | 30 | | | |
|---|---|---|---|---|---|---|---|---|---|---|---|---|---|
| | FREQUENCY (kHz) | 0.1 | 0.3 | 0.5 | 1 | 0.1 | 0.3 | 0.5 | 1 | 0.1 | 0.3 | 0.5 | 1 |
| Vpp (kV) | 1.0 | ○ | ○ | ○ | ○ | ○ | ○ | ○ | ○ | ○ | ○ | ○ | ○ |
| | 1.5 | ○ | ○ | ○ | ○ | ○ | ○ | ○ | ○ | ○ | ○ | ○ | △ |

○ : NO SCATTERING OF TONER

△ : SLIGHT SCATTERING OF TONER

× : APPARENT SCATTERING OF TONER

TRANSFER DEVICE AND IMAGE FORMING APPARATUS WITH ELECTRICAL POWER SUPPLY

CROSS-REFERENCE TO RELATED APPLICATIONS

This application is based on and claims priority under 35 USC 119 from Japanese Patent Application. No. 2013-155060 filed Jul. 25, 2013.

BACKGROUND

Technical Field

The present invention relates to a transfer device and an image forming apparatus.

SUMMARY

According to an aspect of the invention, there is provided a transfer device including a first-transfer power supply that includes a direct-current power supply and an alternating-current power supply, and a first-transfer member that transfers a toner image formed on an outer peripheral surface of an image carrier to a receiving member from which the toner image is transferred to a medium. The first-transfer member transfers the toner image by receiving a voltage from the first-transfer power supply.

BRIEF DESCRIPTION OF THE DRAWINGS

Exemplary embodiments of the present invention will be described in detail based on the following figures, wherein:

FIG. 13 is a table summarizing conditions set forth for evaluations conducted on Working Examples 1 to 5 and Comparative Examples 1 to 4;

FIG. 15A is a table summarizing the results of an experiment on the transferability of toner that has been transferred to a piece of embossed paper in Comparative Example 3;

FIG. 15B is a table summarizing the results of an experiment on the scattering of toner that has been transferred to a piece of embossed paper in Comparative Example 3;

FIG. 16A is a table summarizing the results of an experiment on the transferability of toner that has been transferred to a piece of embossed paper in Working Example 1;

FIG. 16B is a table summarizing the results of an experiment on the scattering of toner that has been transferred to a piece of embossed paper in Working Example 1;

FIG. 18A is a table summarizing the results of an experiment on the transferability of toner that has been transferred to a piece of embossed paper in Comparative Example 4;

FIG. 18B is a table summarizing the results of an experiment on the scattering of toner that has been transferred to a piece of embossed paper in Comparative Example 4;

FIG. 19A is a table summarizing the results of an experiment on the transferability of toner that has been transferred to a piece of embossed paper in Working Example 4;

FIG. 19B is a table summarizing the results of an experiment on the scattering of toner that has been transferred to a piece of embossed paper in Working Example 4;

FIG. 20A is a table summarizing the results of an experiment on the transferability of toner that has been transferred to a piece of embossed paper in Working Example 5; and FIG. 20B is a table summarizing the results of an experiment on the scattering of toner that has been transferred to a piece of embossed paper in Working Example 5.

DETAILED DESCRIPTION

First Exemplary Embodiment

A first exemplary embodiment of the present invention will now be described with reference to associated drawings. A configuration of an image forming apparatus will be described first, followed by a configuration of a transfer device. In the following description, a direction indicated by arrow H illustrated in FIG. 1 is referred to as apparatus height direction, a direction indicated by arrow W illustrated in FIG. 1 is referred to as apparatus width direction, and a direction orthogonal to both the apparatus height direction and the apparatus width direction is referred to as apparatus depth direction.

Configuration of Image Forming Apparatus

Overall Configuration

Figure 1:
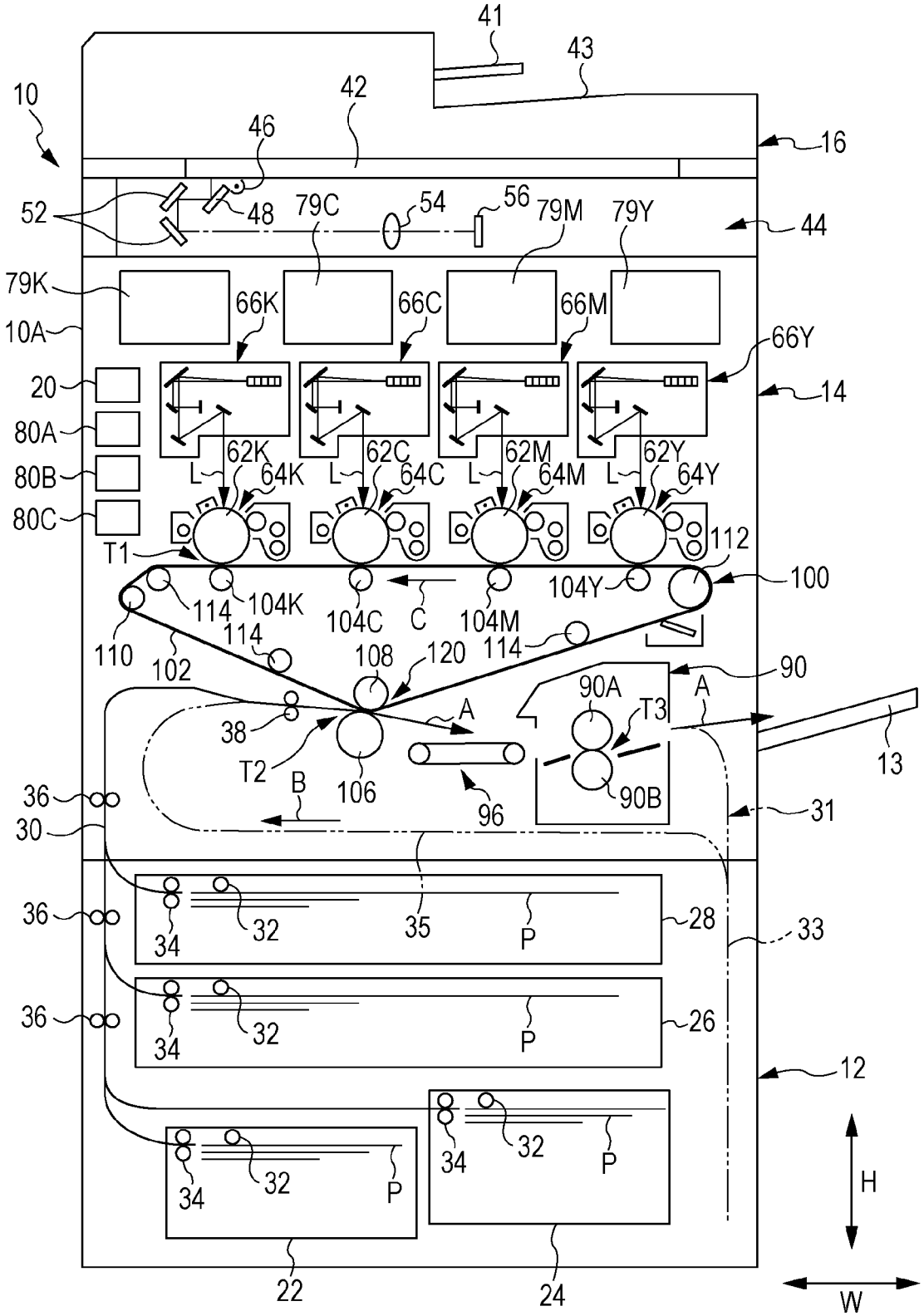
FIG. 1 schematically illustrates the entirety of an image forming apparatus according to a first exemplary embodiment.

FIG. 1 is a schematic front view illustrating the entirety of an image forming apparatus 10 according to the first exemplary embodiment. As illustrated in FIG. 1, the image forming apparatus 10 includes a recording medium storage section 12 that contains pieces of recording medium P, an image forming section 14 that forms an image on a piece of recording medium P, and a document reading section 16 that reads a document (not illustrated). The image forming apparatus 10 further includes a controller 20 and a power supply unit 80A. The controller 20 controls the above sections 12, 14, and 16. The power supply unit 80A supplies power to the sections 12, 14, and 16 and to the controller 20. The recording medium P is an exemplary medium.

Recording Medium Storage Section

The recording medium storage section 12 includes a first storage unit 22, a second storage unit 24, a third storage unit 26, and a fourth storage unit 28 (hereinafter simply referred to as storage units) provided for pieces of recording medium P that are of respectively different sizes. The storage units each include a feed roller 32 that feeds out the pieces of recording medium P one by one, and a pair of transport rollers 34 that transports each piece of recording medium P that has been fed thereto to a transport path 30 provided in the image forming apparatus 10.

Transport Section

A transport section extends over the recording medium storage section 12 and the image forming section 14. The transport section is a transport mechanism along which a piece of recording medium P that has been fed out by the feed roller 32 provided to any of the storage units is transported through a second-transfer nip T2 (see FIG. 1) and a fixing device 90 and is discharged to a discharge portion 13. The transport section includes transport paths 30, 31, 33, and 35.

Three pairs of transport rollers 36 that transport the piece of recording medium P are provided along the transport path 30 on the downstream side with respect to the pairs of transport rollers 34 provided to the storage units. One of the three pairs of transport rollers 36 that is on the most downstream side in the direction of transport of the recording medium P is provided in the image forming section 14. A pair of registration rollers 38 is provided on the downstream side in the direction of transport of the recording medium P with respect to the most downstream pair of transport rollers 36. The pair of registration rollers 38 temporarily stops the piece of recording medium P and sends the piece of recording medium P to the second-transfer nip T2 at a predetermined timing, thereby registering the piece of recording medium P with the position of transfer of a toner image.

The fixing device 90 is provided at a position of the transport path 30 that is on the downstream side with respect to the second-transfer nip T2. The fixing device 90 fixes the toner image that has been transferred to the piece of recording medium P on the recording medium P. The discharge portion 13 to which the piece of recording medium P having the fixed toner image is discharged is provided on the downstream side with respect to the fixing device 90.

An assistant transport member 96 that transports the piece of recording medium P having the transferred toner image to the fixing device 90 is provided between the second-transfer nip T2 and the fixing device 90.

The image forming apparatus 10 is capable of forming images on both sides of the piece of recording medium P. Specifically, the transport path 30 is connected to a duplex transport path 31 in which the piece of recording medium P is transported and is thus reversed. The duplex transport path 31 includes a reversing portion 33 and a transporting portion 35. The reversing portion 33 extends linearly in the apparatus height direction from the image forming section 14 to the recording medium storage section 12. The piece of recording medium P that has been transported into the reversing portion 33 enters the transporting portion 35 from the trailing end thereof and is transported along the transporting portion 35 in a direction indicated by arrow B.

The downstream end of the transporting portion 35 is connected to the transport path 30 with a guiding member (not illustrated) at a position on the upstream side with respect to the pair of registration rollers 38. Plural pairs of transport rollers (not illustrated) are provided to the reversing portion 33 and the transporting portion 35 and are arranged at predetermined intervals. The transport path 30 and the duplex transport path 31 are switched therebetween by a switching member (not illustrated).

Image Forming Section

Figure 2:
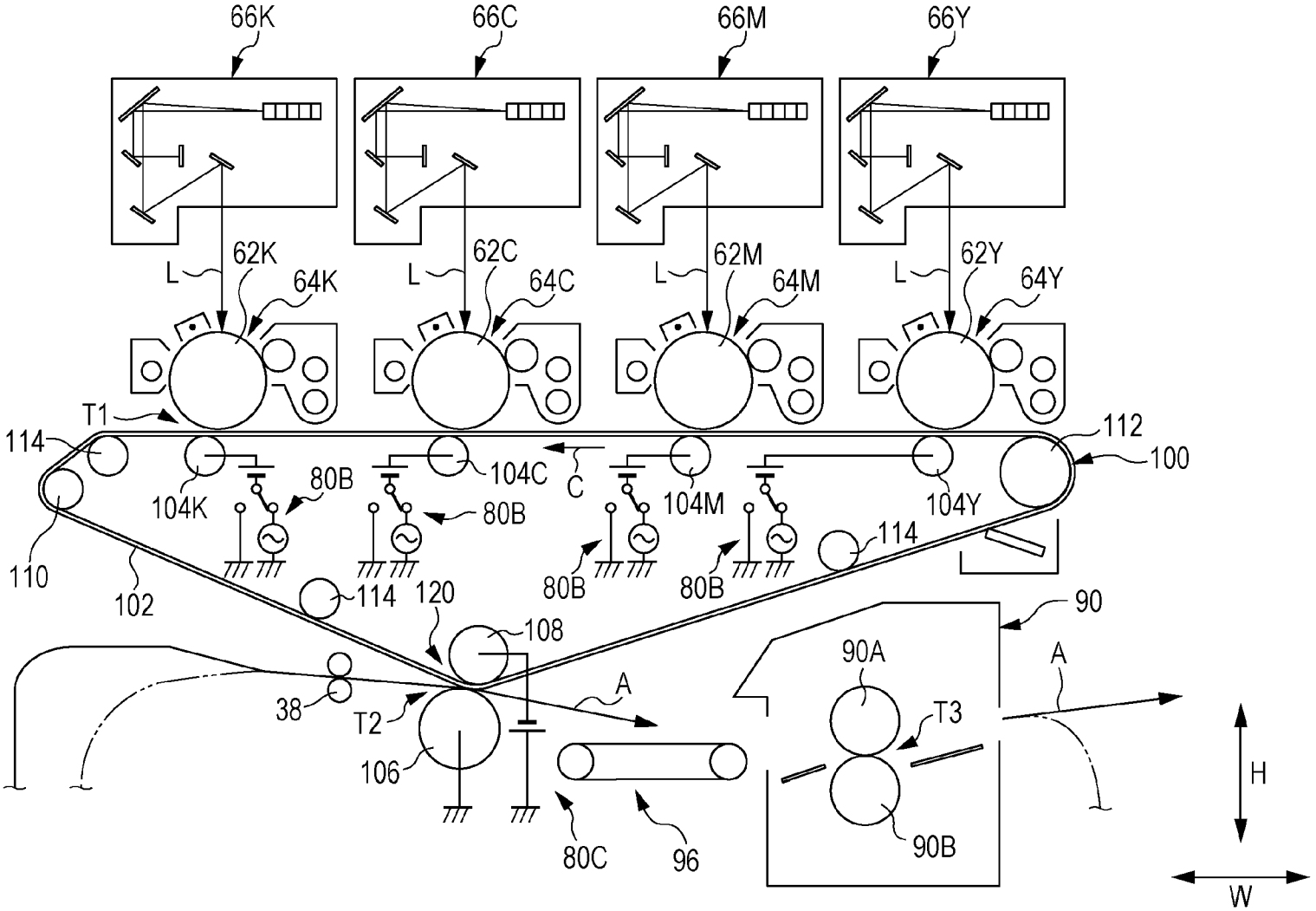
FIG. 2 schematically illustrates an image forming section included in the image forming apparatus according to the first exemplary embodiment.

FIG. 2 is a schematic front view of the image forming section 14 included in the image forming apparatus 10 according to the first exemplary embodiment. The image forming section 14 includes toner-image-forming units 64Y, 64M, 64C, and 64K, a transfer device 100, and the fixing device 90. The toner-image-forming units 64Y, 64M, 64C, and 64K form toner images in colors of yellow (Y), magenta (M), cyan (C), and black (K), respectively. In the transfer device 100, toner images formed by the respective toner-image-forming units 64Y, 64M, 64C, and 64K are transferred to a transfer belt 102, to be described below, in such a manner as to be superposed one on top of another, and the superposition of toner images is transferred from the transfer belt 102 to a piece of recording medium P. The fixing device 90 fixes the superposition of toner images that has been transferred to the piece of recording medium P on the piece of recording medium P.

Toners having the respective colors of yellow (Y), magenta (M), cyan (C), and black (K) are exemplary toners employed in the first embodiment. Toners having any other colors may be alternatively employed. The transfer belt 102 is an exemplary receiving member.

Suffixes Y, M, C, and K added to some reference numerals denote yellow, magenta, cyan, and black, respectively, and are hereinafter omitted unless associated elements need to be distinguished thereamong by Y, M, C, and K.

Toner-Image-Forming Unit

Figure 3:
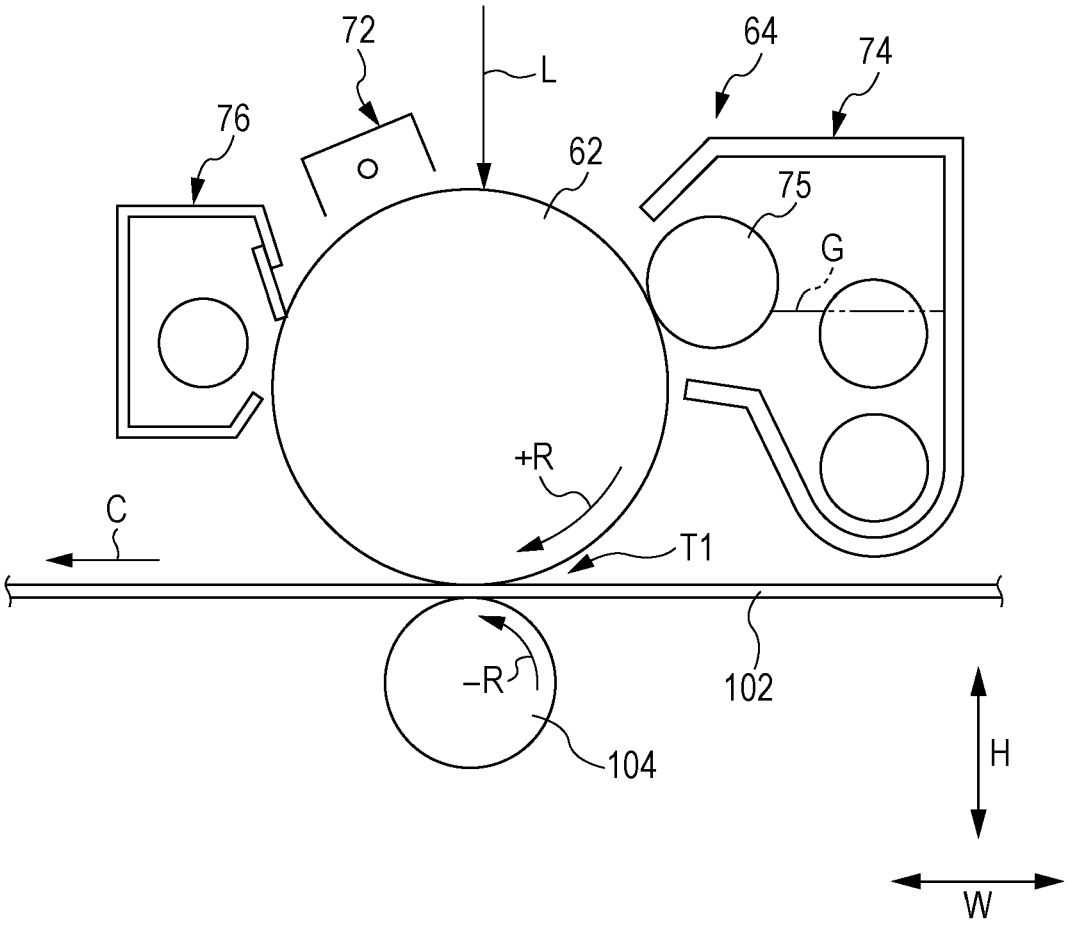
FIG. 3 schematically illustrates one of toner-image-forming units and peripheral elements included in the image forming section according to the first exemplary embodiment.

FIG. 3 is a schematic front view of one of the toner-image-forming units 64 included in the image forming section 14 according to the first exemplary embodiment. In FIG. 3, some elements of the transfer device 100 (the transfer belt 102 and a first-transfer roller 104 to be described below) that are not included in the toner-image-forming unit 64 are also illustrated. Basically, the toner-image-forming units 64 all have the same configuration.

Each toner-image-forming unit 64 includes a photoconductor drum 62, a charging device 72, an exposure device 66, a developing device 74, and a charge eliminating device 76. The photoconductor drum 62 is an exemplary image carrier.

Photoconductor Drum

The photoconductor drum 62 has a cylindrical shape and is driven by a driving device (not illustrated) in such a manner as to rotate on its axis (in a direction indicated by arrow +R). The photoconductor drum 62 includes an aluminum cylinder and photosensitive layers including a base layer, a charge generating layer, and a charge transporting layer that are provided over the cylinder in that order. The cylinder is grounded at zero volts.

The photoconductor drum 62 exhibits an insulating characteristic in an environment that is shielded from light (in the environment in the image forming apparatus 10), but a portion of the photoconductor drum 62 that has been exposed to light emitted from the exposure device 66 exhibits a semiconducting characteristic. When the outer peripheral surface of the photoconductor drum 62 is charged by the charging device 72 and receives the light emitted from the exposure device 66, an electrostatic latent image is formed on the outer peripheral surface of the photoconductor drum 62. An overcoat layer may be additionally provided on the charge transporting layer so that an electrostatic latent image is formed on the outer peripheral surface of the overcoat layer. As illustrated in FIG. 1, the photoconductor drums 62 that form toner images in the respective colors are arranged linearly in the apparatus width direction.

Charging Device

The charging device 72 negatively charges the outer peripheral surface of the photoconductor drum 62. In the first exemplary embodiment, the charging device 72 is a scorotron charging device (see FIG. 3) of a corona-discharge type (non-contact-charging type).

Exposure Device

The exposure device 66 (see FIGS. 1 and 2) forms an electrostatic latent image on the outer peripheral surface of the photoconductor drum 62 that has been charged by the charging device 72. The electrostatic latent image is formed in accordance with image data transmitted to the exposure device 66 from an image signal processor (not illustrated) included in the controller 20. Specifically, in the exposure device 66, a light beam emitted from a light source (illustrated without a reference numeral) is scanningly moved by a rotating polygon mirror (illustrated without a reference numeral). The light beam is reflected by plural optical components including mirrors, producing a light beam L for a corresponding one of the toners. The light beam L is thus emitted from the exposure device 66 toward the photoconductor drum 62. The exposure device 66 is provided on the upper side of the photoconductor drum 62 in the apparatus height direction.

Developing Device

The developing device 74 (see FIG. 3) develops the electrostatic latent image that has been formed on the outer peripheral surface of the photoconductor drum 62 into a toner image. Although detailed description of the developing process is omitted, the developing device 74 includes a container 74A that contains developer G, and a developing roller 75 that supplies the developer G in the container 74A to the photoconductor drum 62. The developer G is composed of a toner and a carrier. The toner is to be negatively charged.

The container 74A that contains the developer G is connected to a corresponding one of cartridges 79 (see FIG. 1) via a supply path (not illustrated) so that the developer G is supplied to the container 74A. As illustrated in FIG. 1, the cartridges 79 are provided on the upper side of the respective photoconductor drums 62 and the respective exposure devices 66 in the apparatus height direction. The cartridges 79 are arranged linearly in the apparatus width direction. The cartridges 79 are individually interchangeable.

Charge Eliminating Device

The charge eliminating device 76 (see FIG. 3) includes a blade (illustrated without a reference numeral) with which toner remaining on the outer peripheral surface of the photoconductor drum 62 after the first transfer of the toner image to the transfer device 100 is scraped from the outer peripheral surface of the photoconductor drum 62. The charge eliminating device 76 further includes a container (illustrated without a reference numeral) in which the toner scraped by the blade is collected, and a transporting device (not illustrated) that transports the toner in the container to a waste toner box (not illustrated).

Transfer Device

The transfer device 100 includes the transfer belt 102, first-transfer rollers 104Y, 104M, 104C, and 104K, plural rollers 110, 112, and 114, a second-transfer roller 106, and a counter roller 108 (see FIGS. 1 and 2). The transfer device 100 further includes first-transfer power supplies 80B and a second-transfer power supply 80C. The first-transfer rollers 104Y, 104M, 104C, and 104K are exemplary first-transfer members. A second-transfer unit 120 includes the second-transfer roller 106, a portion of the transfer belt 102 at the second-transfer nip T2, and the counter roller 108. The second-transfer unit 120 is an exemplary second-transfer member.

The first-transfer power supplies 80B supply power to the respective first-transfer rollers 104Y, 104M, 104C, and 104K. The second-transfer power supply 80C supplies power to the counter roller 108.

The transfer belt 102 is endless and is stretched around the counter roller 108 and the plural rollers 110, 112, and 114, whereby the position of the transfer belt 102 is determined. In the first exemplary embodiment, the transfer belt 102 has an inverted obtuse-triangular shape in front view, with the longest side thereof extending in the apparatus width direction.

The roller 112 functions as a driving roller that causes the transfer belt 102 to rotate in a direction indicated by arrow C with power generated by a motor (not illustrated). The roller 110 functions as a tension applying roller that applies a tension to the transfer belt 102.

The upper side of the transfer belt 102 positioned as described above extends in the apparatus width direction and is in contact with the photoconductor drums 62, which form toner images in the respective colors, from the lower side in the vertical direction, whereby first-transfer nips T1 (see FIGS. 1 and 3) are formed. The first-transfer power supplies 80B apply first-transfer voltages to the respective first-transfer rollers 104, whereby the toner images that have been developed on the outer peripheral surfaces of the respective photoconductor drums 62 are transferred to the transfer belt 102.

The transfer belt 102 is in contact with the second-transfer roller 106 with the aid of the counter roller 108 at a vertex thereof forming an obtuse angle on the lower side in the vertical direction, whereby the second-transfer nip T2 is formed. The counter roller 108 receives a second-transfer voltage and thus transfers the superposition of toner images to the piece of recording medium P passing through the second-transfer nip T2. In the second transfer, the counter roller 108 receives the second-transfer voltage from the second-transfer power supply 80C, and the second-transfer roller 106 is grounded at zero volts.

If only a toner image in a specific color, for example, black (K), is to be transferred to a piece of recording medium P, only a toner image in black (K) is formed by the toner-image-forming unit 64K. Subsequently, only the toner image in black (K) is transferred to the transfer belt 102 and is then transferred to a piece of recording medium P. The transfer device 100, which is the featured element of the first exemplary embodiment, will be described separately below.

Fixing Device

The fixing device 90 fixes the superposition of toner images that has been transferred to the piece of recording medium P by the transfer device 100 on the recording medium P (see FIGS. 1 and 2). In the first exemplary embodiment, the fixing device 90 heats and presses the superposition of toner images at a fixing nip T3, thereby fixing the superposition of toner images on the piece of recording medium P. The fixing nip T3 corresponds to a nip formed between a heat roller 90A and a pressure roller 90B.

Document Reading Section

As illustrated in FIG. 1, the document reading section 16 includes a document tray 41 on which a document (not illustrated) is to be placed, a platen glass 42 on which a sheet of a document is to be placed, a document reading device 44 that reads the sheet of the document placed on the platen glass 42, and a document discharge portion 43 to which the sheet of the document that have been read is discharged.

The document reading device 44 includes a light-emitting portion 46 that applies light to the sheet of the document placed on the platen glass 42. The document reading device 44 further includes one full-rate mirror 48 and two half-rate mirrors 52 that in combination cause the light emitted from the light-emitting portion 46 and reflected by the sheet of the document to be reflected and redirected in a direction parallel to the platen glass 42. The document reading device 44 further includes an imaging lens array 54 on which the light reflected and redirected by the full-rate mirror 48 and the two half-rate mirrors 52 is incident. The document reading device 44 further includes a photoelectric conversion element 56 that converts the light that is in the form of an image produced by the imaging lens array 54 into an electrical signal.

The full-rate mirror 48 moves along the platen glass 42 at a full rate. The half-rate mirrors 52 each move along the platen glass 42 at a half rate.

Operation of Image Forming Apparatus

An image forming operation performed on a piece of recording medium P by the image forming apparatus 10 will now be described.

When the controller 20 (see FIG. 1) receives an image forming command, the controller 20 activates the toner-image-forming units 64, the transfer device 100, and the fixing device 90. In response to this, the photoconductor drums 62 and the developing rollers 75 rotate on their respective axes, and the transfer belt 102 rotates in the direction of arrow C. Furthermore, the heat roller 90A and the pressure roller 90B included in the fixing device 90 rotate. Synchronously with such operations, the controller 20 also activates the pairs of transport rollers 36, the pair of registration rollers 38, the assistant transport member 96, and other associated elements.

Subsequently, the photoconductor drums 62 are charged by the respective charging devices 72 while rotating on their axes. Image data is processed by the image signal processor included in the controller 20 and is sent from the controller 20 to the exposure devices 66. Subsequently, the exposure devices 66 emit respective light beams L that are based on the image data toward the charged outer peripheral surfaces of the respective photoconductor drums 62, whereby electrostatic latent images are formed thereon. The electrostatic latent images on the respective photoconductor drums 62 are developed into toner images with toners having the respective colors and supplied from the respective developing devices 74, whereby toner images in the respective colors are formed on the respective photoconductor drums 62.

The toner images on the respective photoconductor drums 62 are sequentially transferred to the transfer belt 102 that is under rotation, by the respective first-transfer rollers 104 that are subject to respective first-transfer voltages, whereby a superposition of toner images in the respective colors is formed on the transfer belt 102. The superposition of toner images is transported to the second-transfer nip T2 with the rotation of the transfer belt 102. Meanwhile, a piece of recording medium P is supplied to the second-transfer nip T2 by the pair of registration rollers 38 in accordance with the timing of transport of the superposition of toner images. Furthermore, a second-transfer voltage is applied to the counter roller 108, whereby the superposition of toner images on the transfer belt 102 is transferred to the piece of recording medium P at the second-transfer nip T2.

The piece of recording medium P having the superposition of toner images is transported from the second-transfer nip T2 in the transfer device 100 to the fixing nip T3in the fixing device 90 by the assistant transport member 96. The piece of recording medium P passing through the fixing nip T3receives heat and pressure (fixing energy) from the fixing device 90, whereby the superposition of toner images that has been transferred to the piece of recording medium P is fixed on the piece of recording medium P.

The piece of recording medium P is then discharged from the fixing device 90 and is transported along the transport path 30 toward the discharge portion 13 provided on the outside of the image forming apparatus 10. Thus, the image forming operation performed on the piece of recording medium P is complete.

Configuration of Featured Element (Transfer Device)

The transfer device 100, which is an exemplary featured element in the first embodiment, will now be described with reference to associated drawings. The first-transfer power supplies 80B that supply power to the respective first-transfer rollers 104 each include a direct-current power supply and an alternating-current power supply. The second-transfer power supply 80C that supplies power to the counter roller 108 includes a direct-current power supply.

To transfer the toner images on the outer peripheral surfaces of the respective photoconductor drums 62 to the transfer belt 102, the transfer device 100 has a first mode in which a direct-current voltage and an alternating-current voltage are applied to each of the first-transfer rollers 104 and a second mode in which only a direct-current voltage is applied to each of the first-transfer rollers 104. The transfer device 100 is selectively operable between the first mode and the second mode. When the first mode is selected for the transfer device 100, the first-transfer power supplies 80B each apply a direct-current voltage and an alternating-current voltage to a corresponding one of the first-transfer rollers 104. When the second mode is selected for the transfer device 100, the first-transfer power supplies 80B each apply only a direct-current voltage to a corresponding one of the first-transfer rollers 104. The first mode is an exemplary alternating-current mode. The second mode is an exemplary direct-current mode.

When the user desires the document reading device 44 of the image forming apparatus 10 to read a document, the user is allowed to select the type of the recording medium P on a user interface (abbreviated to UI, not illustrated) included in the document reading section 16. When the user desires to send an image forming command to the image forming apparatus 10 from an external apparatus, such as a personal computer (not illustrated), the user is allowed to select the type of the recording medium P on a UI (not illustrated), such as an application for making settings of the image forming operation, displayed on the external apparatus.

Information on the type of the recording medium P selected by the user is sent to the transfer device 100 via the controller 20. Then, the transfer device 100 operates in the first mode if the user selects embossed paper as the type of the recording medium P or in the second mode if the user selects plain paper as the type of the recording medium P. Embossed paper and plain paper are exemplary media. Specifically, plain paper is an exemplary medium having a predetermined reference surface unevenness, and embossed paper is an exemplary medium having higher surface unevenness than the predetermined reference surface unevenness. The surface unevenness is a parameter representing the degree of unevenness on the surface, i.e., the surface roughness.

Figure 4:
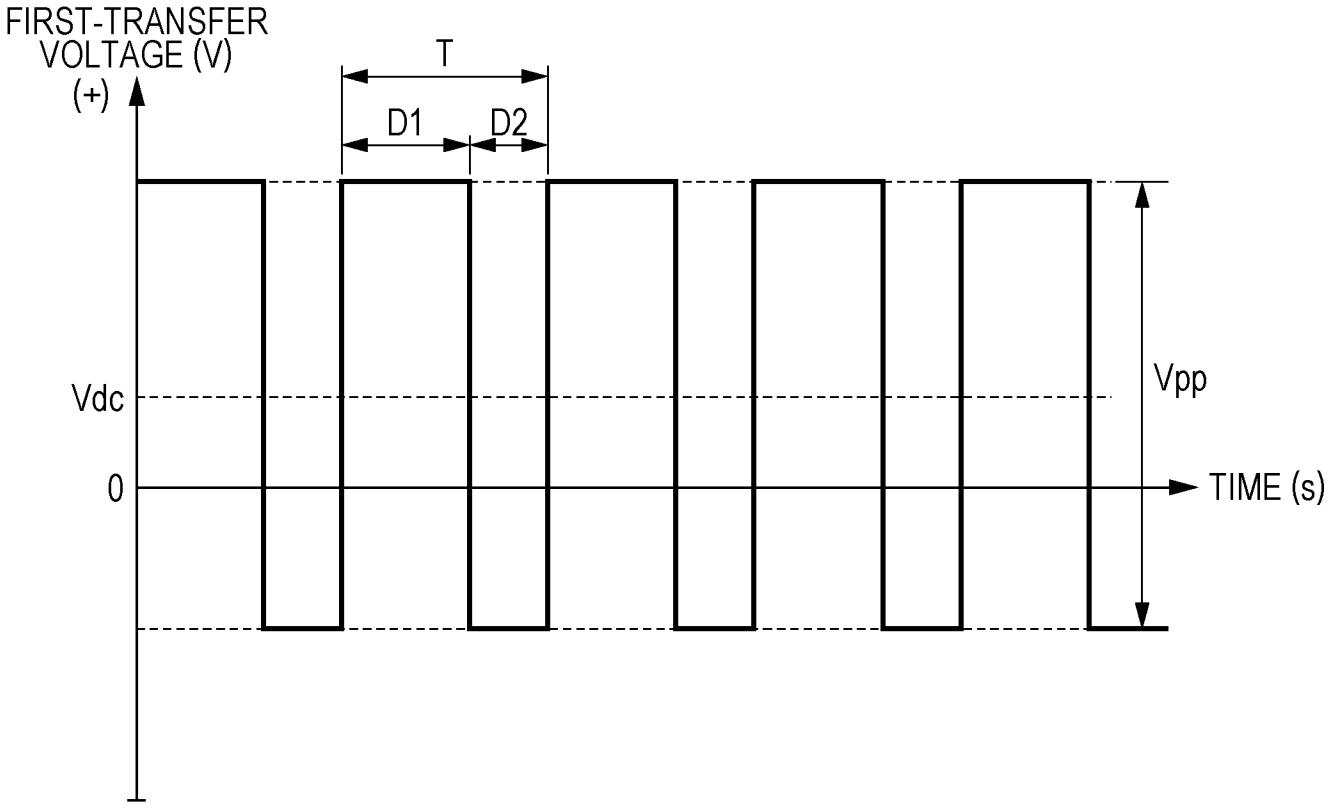
FIG. 4 is a graph of a voltage applied to each of first-transfer rollers included in a transfer device according to the first exemplary embodiment.

If the first mode is selected for the transfer device 100, a rectangular-wave voltage is applied to each of the first-transfer rollers 104 (see FIG. 4). The rectangular-wave voltage alternates between a positive value and a negative value with respect to zero volts. The rectangular-wave voltage is at a frequency T. The positive voltage lasts for a period D1. The negative voltage lasts for a period D2 that is shorter than the period D1. Letting the difference between the maximum value and the minimum value of the rectangular-wave voltage be Vpp, the amplitude of the rectangular-wave voltage is ½ Vpp. The amplitude of ½ Vpp of the rectangular-wave voltage occurs at the frequency T with respect to a positive voltage Vdc.

The frequency T in the first mode is shorter than a period over which a certain portion of the outer peripheral surface of any of the photoconductor drums 62 passes through a corresponding one of the first-transfer nips T1. In other words, the frequency T is smaller than a value obtained by dividing the length of the first-transfer nip T1 by the speed of rotation of the outer peripheral surface of the photoconductor drum 62. While the portion of the outer peripheral surface of the photoconductor drum 62 passes through the first-transfer nip T1, the voltage applied to each first-transfer roller 104 alternates between a positive value and a negative value plural times. Herein, the term "the length of the first-transfer nip T1" refers to the circumferential length of an area where a pressing force is produced between the photoconductor drum 62 and the transfer belt 102 that is pressed by the first-transfer roller 104.

If the second mode is selected for the transfer device 100, the first-transfer power supplies 80B each apply only a direct-current voltage (not illustrated) to a corresponding one of the first-transfer rollers 104.

First Exemplary Embodiment

If the user selects embossed paper on the UI, the transfer device 100 operates in the first mode. Accordingly, the first-transfer power supplies 80B each apply the rectangular-wave voltage illustrated in FIG. 4 to a corresponding one of the first-transfer rollers 104 in accordance with the timing of the first transfer. Then, the rectangular-wave voltage illustrated in FIG. 4 produces electric fields at the first-transfer nip T1and in the gaps between the transfer belt 102 and portions of the outer peripheral surface of the photoconductor drum 62 that are on the upstream side and the downstream side, respectively, of the first-transfer nip T1. Meanwhile, the toner image on the outer peripheral surface of the photoconductor drum 62 is transported to the first-transfer nip T1with the rotation of the photoconductor drum 62. Then, the toner image on the outer peripheral surface of the photoconductor drum 62 is transferred to the transfer belt 102 at the first-transfer nip T1.

Here, as a first comparative embodiment, suppose that a transfer device transfers a toner image that has been formed on the outer peripheral surface of a photoconductor drum to a transfer belt, before transferring the toner image to a piece of embossed paper, by applying only a direct-current voltage to a first-transfer roller. In such a case, the toner image that has been transferred to the transfer belt is more negatively charged than before being transferred until the toner image finishes passing through the gap on the downstream side of the first-transfer nip T1, because of the discharge that occurs between the outer peripheral surface of the photoconductor drum and the transfer belt.

In contrast, the toner image that has been transferred in the first mode is more negatively charged than before being transferred during the application of the positive voltage (during the period D1), because of the discharge that occurs between the outer peripheral surface of the photoconductor drum 62 and the transfer belt 102 (see FIG. 4). Subsequently, the amount of negative charge on the toner image is reduced during the application of the negative voltage (during the period D2), because of the discharge that occurs between the outer peripheral surface of the photoconductor drum 62 and the transfer belt 102. Herein, the term "the amount of charge" refers to the amount of charge per unit mass of toner (μC/mg).

Accordingly, the toner image thus transferred in the first mode is affected by the electric fields produced by the rectangular-wave voltage illustrated in FIG. 4. Therefore, the toner image is transferred to the transfer belt 102 with a smaller amount of negative charge than in the first comparative embodiment. Consequently, the toner image that has been transferred in the first mode has a weaker image force with respect to the transfer belt 102 than in the first comparative embodiment.

Hence, in the transfer device 100 according to the first exemplary embodiment, the force with which the toner image that has been transferred to the transfer belt 102 adheres to the transfer belt 102 is smaller than in the first comparative embodiment.

Since the toner image that has been transferred in the first mode adheres to the transfer belt 102 with a smaller force than in the first comparative embodiment, the toner image is easily released from the transfer belt 102.

Figure 17:
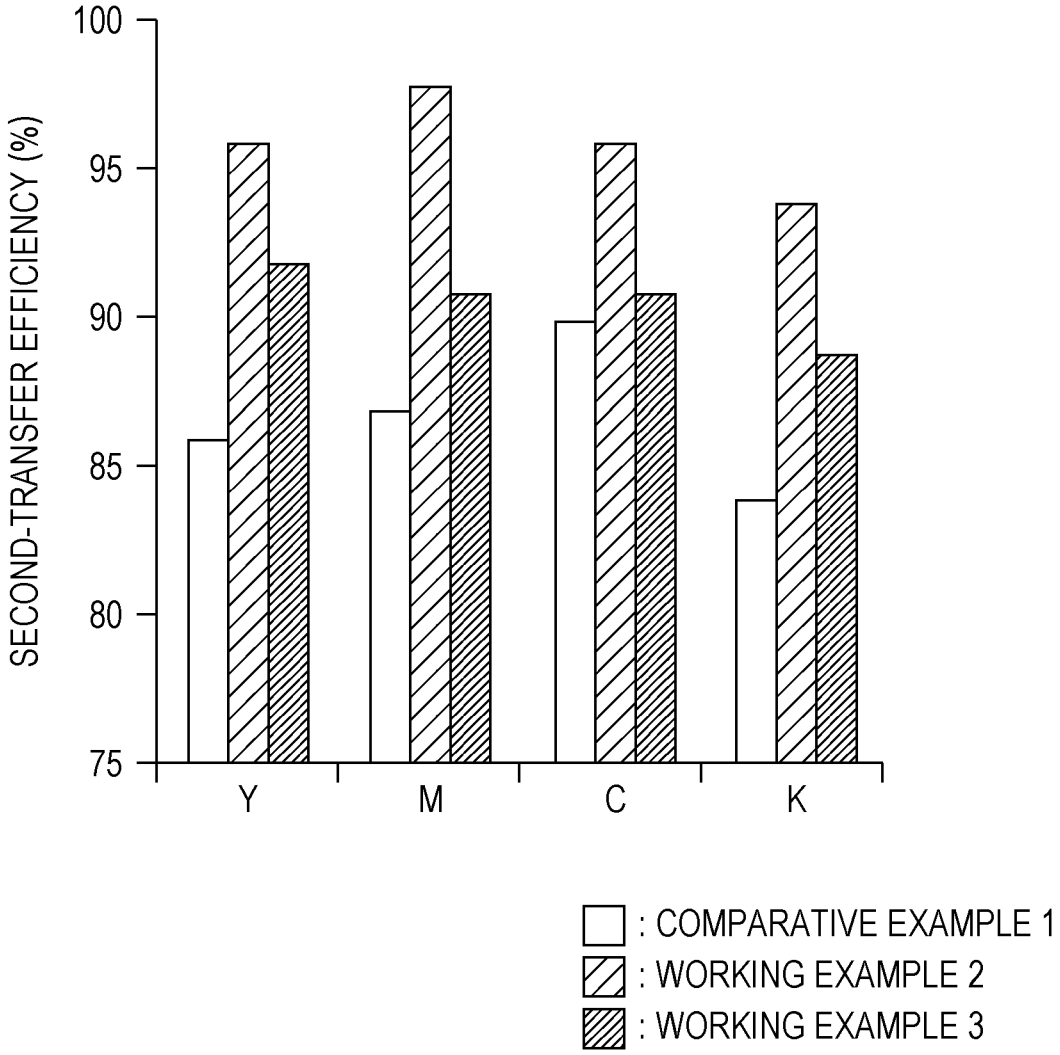
FIG. 17 is a graph illustrating the results of an experiment on the second-transfer efficiency in Working Examples 2 and 3 and Comparative Example 2.

Hence, in the transfer device 100 according to the first exemplary embodiment, the second-transfer efficiency is higher than in the first comparative embodiment (see FIG. 17). This will be described separately below in the description of examples.

In the image forming apparatus 10 including the transfer device 100, since the second-transfer efficiency is improved, the amount of toner consumption is reduced.

Herein, the term "the second-transfer efficiency" refers to the ratio of the amount of toner that has been transferred to a piece of recording medium P with respect to the amount of toner that has been transferred to the transfer belt 102. The second-transfer efficiency is measurable from the ratio of the amount of toner as the residual of subtracting the amount of toner remaining on the transfer belt 102 without being transferred to the piece of recording medium P after the transfer belt 102 has passed through the second-transfer nip T2 from the amount of toner that has been transferred to the transfer belt 102, with respect to the amount of toner that has been transferred to the transfer belt 102. The improvement in the second-transfer efficiency means that the second-transfer efficiency becomes high while the amount of energy is not changed, or that a specific level of the second-transfer efficiency is realized with a smaller amount of energy.

In the second transfer of such a transferred toner image, it is difficult to bring the toner image on the transfer belt 102 into contact with recesses in a piece of embossed paper at the second-transfer nip T2. Even if the toner image has successfully come into contact with the recesses, the pressing force applied thereto is small. Compared with the case of the first comparative embodiment, however, a toner image that has been transferred in the first mode is easily released from the transfer belt 102. Hence, in the transfer device 100 according to the first exemplary embodiment, the second-transfer efficiency for embossed paper is higher than in the first comparative embodiment.

On the other hand, if the second mode is selected, the first-transfer power supplies 80B each apply only a direct-current voltage to a corresponding one of the first-transfer rollers 104 in accordance with the timing of the first transfer. In such a case, the power consumption is smaller than in a case where an alternating-current voltage is applied to each of the first-transfer rollers 104.

Here, as a second comparative embodiment, suppose that a transfer device transfers a toner image that has been formed on the outer peripheral surface of a photoconductor drum to a transfer belt, before transferring the toner image to a piece of plain paper, by applying an alternating-current voltage and a direct-current voltage to a first-transfer roller. In such a case, the toner image that has been transferred to the transfer belt adheres to the transfer belt with a smaller force than a toner image that has been transferred in the second mode. In addition, plain paper has lower surface unevenness than embossed paper. Therefore, the toner image is more likely to be displaced on the piece of plain paper.

In contrast, a toner image that has been transferred in the second mode adheres to the transfer belt 102 with a larger force than in the second comparative embodiment. That is, in the second transfer, the toner image that has been transferred in the second mode adheres to the transfer belt 102 with a larger force than in the second comparative embodiment. Hence, the displacement of the toner image that may occur in the second transfer to a piece of plain paper is reduced.

Accordingly, in the transfer device 100 according to the first exemplary embodiment, the displacement of the toner image that may occur in the second transfer to a piece of plain paper is smaller than in the second comparative embodiment.

Furthermore, in the transfer device 100 according to the first exemplary embodiment, no alternating-current voltage is applied to any of the first-transfer rollers 104 in the second mode. Therefore, the power consumption is reduced.

As described above, the transfer device 100 is selectively operable between the first mode and the second mode. That is, the transfer device 100 according to the first exemplary embodiment is capable of operating in a more appropriate mode than a transfer device that is not selectively operable between the first mode and the second mode. Consequently, if the first mode is selected, the second-transfer efficiency is improved. If the second mode is selected, the displacement of the toner image that may occur in the second transfer to a piece of plain paper is reduced. Such an operation performed on a piece of plain paper is also performed on a piece of coated paper.

While the above description concerns a case where the transfer device 100 operates in the first mode if the user selects embossed paper on the UI, the transfer device 100 may also operate in the first mode even if the user selects plain paper. If the first mode is selected for plain paper, the second-transfer efficiency is improved more than in the second mode. If the second mode is selected for plain paper, the image quality is improved more than in the first mode.

Second Exemplary Embodiment

Configuration According to Second Exemplary Embodiment

A second exemplary embodiment of the present invention will now be described with reference to FIG. 5, focusing on differences from the first exemplary embodiment. Elements (components and so forth) that are the same as in the first exemplary embodiment are denoted by corresponding ones of the reference numerals used therein.

Figure 5:
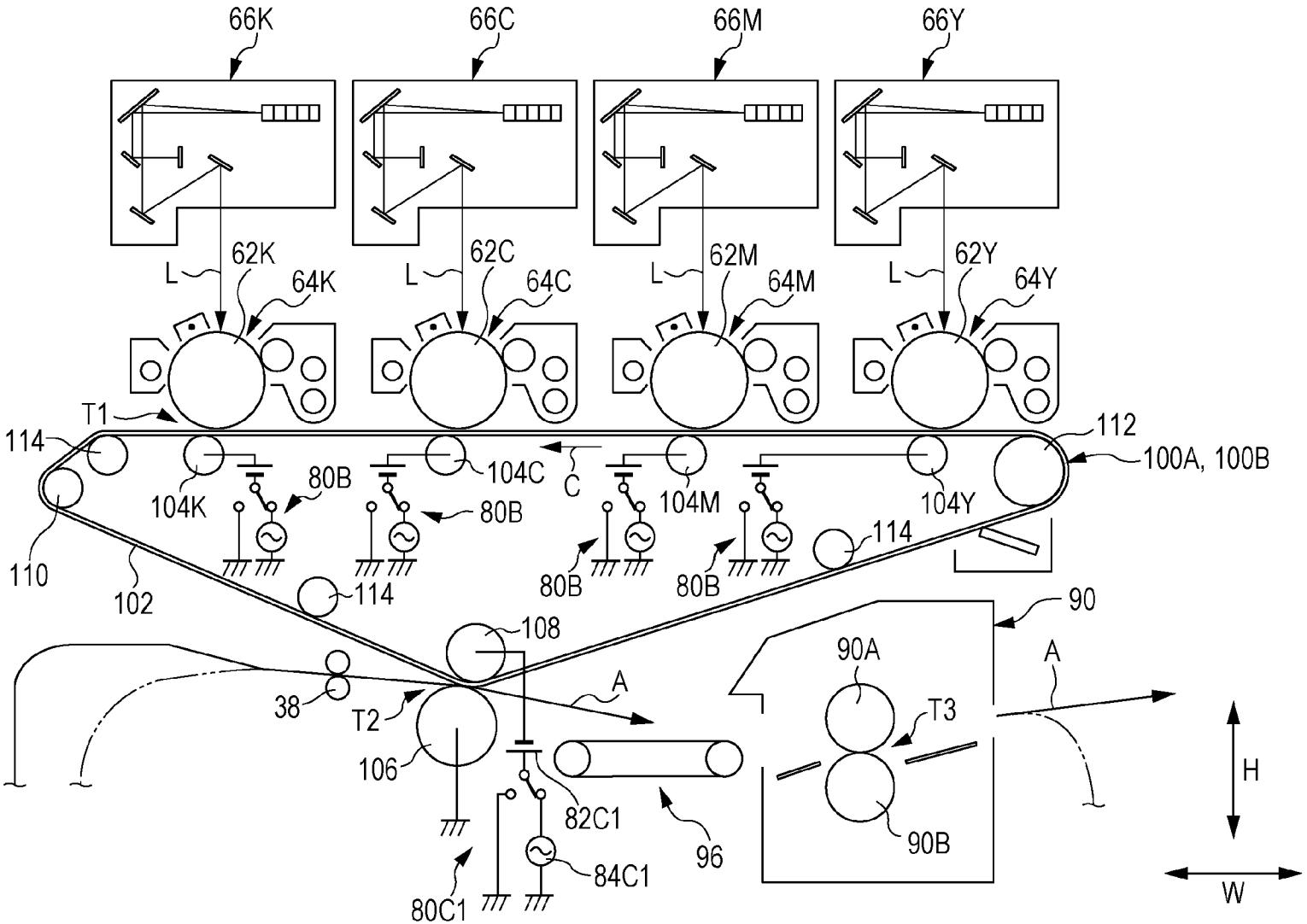
FIG. 5 schematically illustrates an image forming section included in an image forming apparatus according to a second exemplary embodiment.

FIG. 5 is a schematic front view of an image forming section 14 included in an image forming apparatus 10A (corresponding to the image forming apparatus 10 illustrated in FIG. 1) according to the second exemplary embodiment. A second-transfer power supply 80C1 that supplies power to the counter roller 108 includes a direct-current power supply 82C1 and an alternating-current power supply 84C1.

A transfer device 100A (see FIG. 5) according to the second exemplary embodiment has a third mode in addition to the first mode and the second mode. In the third mode, the toner images on the outer peripheral surfaces of the respective photoconductor drums 62 are transferred to the transfer belt 102 with a direct-current voltage and an alternating-current voltage being applied to each of the first-transfer rollers 104 from a corresponding one of the first-transfer power supplies 80B. Furthermore, in the third mode, the toner images thus transferred to the transfer belt 102 are transferred to a piece of recording medium P with a direct-current voltage and an alternating-current voltage being applied to the counter roller 108 from the second-transfer power supply 80C1.

If the third mode is selected for the transfer device 100A, the second-transfer power supply 80C1 applies a rectangular-wave voltage (not illustrated) to the counter roller 108. This voltage alternates between a positive value and a negative value with respect to zero volts.

In the transfer device 100A, the third mode is selected in accordance with the type of the recording medium P to which toner images are to be transferred. Specifically, the third mode is selected if toner images are transferred to a piece of recording medium P, such as embossed paper, having higher surface unevenness than plain paper. If the user selects embossed paper on the UI, the transfer device 100A operates in the third mode.

In the transfer device 100A, when a piece of embossed paper that is stored in any of the storage units is transported to the second-transfer nip T2, the toner images on the transfer belt 102 are transferred to the piece of embossed paper.

Second Exemplary Embodiment

If the user selects embossed paper on the UI, the transfer device 100A operates in the third mode. Accordingly, the first-transfer power supplies 80B each apply the rectangular-wave voltage illustrated in FIG. 4 to a corresponding one of the first-transfer rollers 104 in accordance with the timing of the first transfer. Furthermore, the second-transfer power supply 80C1 applies a rectangular-wave voltage to the counter roller 108 in accordance with the timing of the second transfer.

Meanwhile, the toner images formed on the outer peripheral surfaces of the respective photoconductor drums 62 are transported to the respective first-transfer nips T1 with the rotation of the photoconductor drums 62. If the third mode is selected for the transfer device 100A, a piece of embossed paper stored in any of the storage units is transported to the second-transfer nip T2 in accordance with the timing of the second transfer.

When the piece of embossed paper passes through the second-transfer nip T2, projections on the surface of the piece of embossed paper come into contact with the transfer belt 102 or the toner on the transfer belt 102 while being pressed by the second-transfer roller 106. In contrast, recesses in the surface of the piece of embossed paper do not tend to come into contact with the transfer belt 102 or the toner on the transfer belt 102.

Here, as a third comparative embodiment, suppose that a toner image on the outer peripheral surface of a photoconductor drum is transferred to a transfer belt by applying only a direct-current voltage to a first-transfer roller, and the toner image thus transferred to the transfer belt is transferred to a piece of embossed paper by applying a direct-current voltage and an alternating-current voltage to a counter roller.

In such a case, the force with which the toner image that has been transferred to the transfer belt adheres to the transfer belt is larger than in a case where the toner image is transferred to the transfer belt by applying a direct-current voltage and an alternating-current voltage to the first-transfer roller. Accordingly, to transfer the toner image on the transfer belt to a piece of embossed paper, the amplitude of the alternating-current voltage to be applied to the counter roller needs to be made larger than in the case where the toner image is transferred to the transfer belt by applying a direct-current voltage and an alternating-current voltage to the first-transfer roller.

Figure 14A:
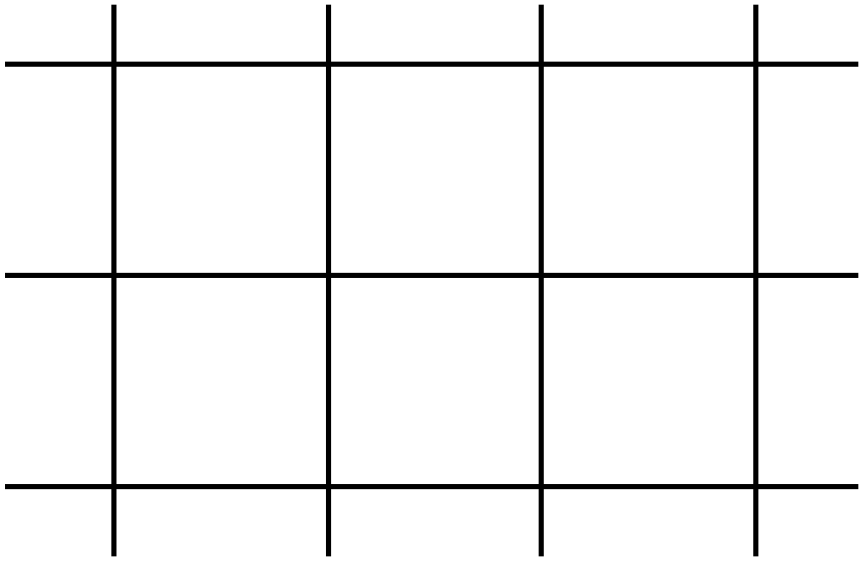
FIG. 14A schematically illustrates a state of a grid-pattern image that has been transferred to a piece of embossed paper in any of Working Examples 1 to 5.
Figure 14B:
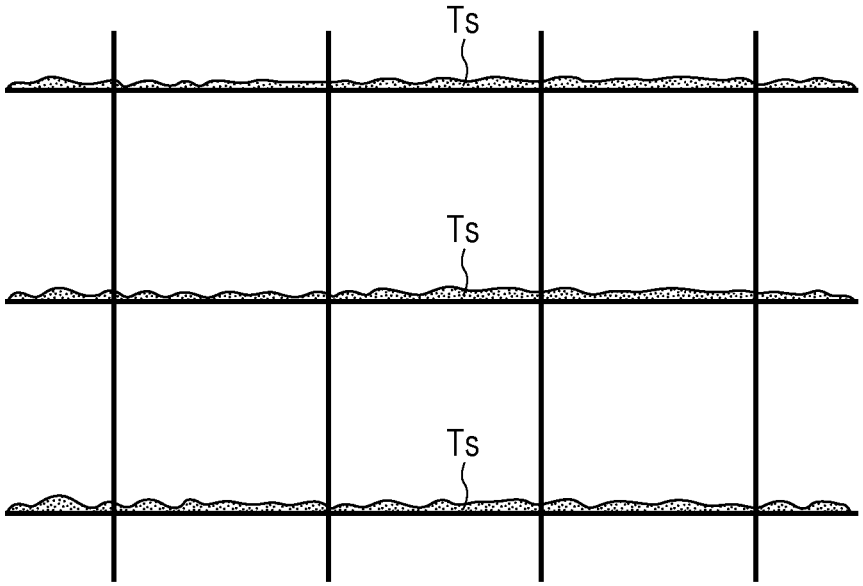
FIG. 14B schematically illustrates a state of a grid-pattern image that has been transferred to a piece of embossed paper in Comparative Example 1.

Therefore, in the third comparative embodiment, the toner forming the toner image that has been transferred to a piece of embossed paper tends to scatter (see FIG. 14B). Such scattering of toner may lead to failure in the second transfer.

In contrast, in the transfer device 100A, if the third mode is selected, the force with which a toner image that has been transferred to the transfer belt 102 adheres to the transfer belt 102 is reduced. Accordingly, in the transfer device 100A, the amplitude of the alternating-current voltage to be applied to the counter roller 108 may be smaller than in the third comparative embodiment.

Hence, in the transfer device 100A according to the second exemplary embodiment, the scattering of toner in the second transfer to a piece of embossed paper is suppressed more than in the third comparative embodiment.

The other operations are the same as in the first exemplary embodiment.

Modification of Second Exemplary Embodiment

Configuration of Modification of Second Exemplary Embodiment

A modification of the second exemplary embodiment will now be described, focusing on differences from the second exemplary embodiment. Elements (components and so forth) that are the same as in the first or second exemplary embodiment are denoted by corresponding ones of the reference numerals used therein.

If the third mode is selected for a transfer device 100B (corresponding to the transfer device 100A illustrated in FIG. 5) according to the modification, at least one of the amplitude of ½ Vpp and the frequency T of the alternating-current voltage to be applied to each of the first-transfer rollers 104 by a corresponding one of the first-transfer power supplies 80B is changed in accordance with the degree of surface unevenness of the embossed paper.

Specifically, in the transfer device 100B, as the degree of surface unevenness of the embossed paper becomes higher, the amplitude of ½ Vpp of the alternating-current voltage to be applied by each first-transfer power supply 80B is made larger and/or the frequency T of the alternating-current voltage is made shorter.

Conditions for changing the amplitude of ½ Vpp and/or the frequency T of the alternating-current voltage in accordance with the degree of surface unevenness of the embossed paper are stored in a memory unit (not illustrated) included in the transfer device 100B. If a toner image is transferred to a piece of embossed paper, an alternating-current voltage having a predetermined amplitude of ½ Vpp and/or at a predetermined frequency T is applied to the first-transfer roller 104 on the basis of the conditions stored in the memory unit.

Embossed paper is classified into plural types in accordance with the degree of surface unevenness. Information on the types of pieces of embossed paper stored in the storage units is also stored in the memory unit. If the user selects a specific type of embossed paper from among the plural types of embossed paper on the UI, the transfer device 100B acquires conditions corresponding to the information on the selected type of embossed paper from the memory unit.

Modification of Second Exemplary Embodiment

In the transfer device 100B according to the modification, if the third mode is selected, the amplitude of ½ Vpp and/or the frequency T of the alternating-current voltage to be applied by each first-transfer power supply 80B is changed in accordance with the degree of surface unevenness of the embossed paper. Specifically, as the degree of surface unevenness of the embossed paper becomes higher, the amplitude of ½ Vpp is made larger or the frequency T is made shorter, or the amplitude of ½ Vpp is made larger and the frequency T is made shorter.

In the transfer device 100B according to the modification, the amplitude of ½ Vpp and/or the frequency T of the alternating-current voltage is set more suitably for the intended type of the embossed paper than in a case where neither the amplitude nor the frequency of the alternating-current voltage to be applied to the first-transfer roller by the first-transfer power supply is changeable in accordance with the degree of surface unevenness of the embossed paper. Hence, in the transfer device 100E according to the modification, the amplitude and the frequency of the alternating-current voltage are set to values that are suitable for the intended type of the embossed paper.

The other operations are the same as in the above exemplary embodiments.

Third Exemplary Embodiment

Configuration According to Third Exemplary Embodiment

A third exemplary embodiment of the present invention will now be described with reference to FIG. 6, focusing on differences from the above exemplary embodiments. Elements (components and so forth) that are the same as in any of the above exemplary embodiments are denoted by corresponding ones of the reference numerals used therein.

Figure 6:
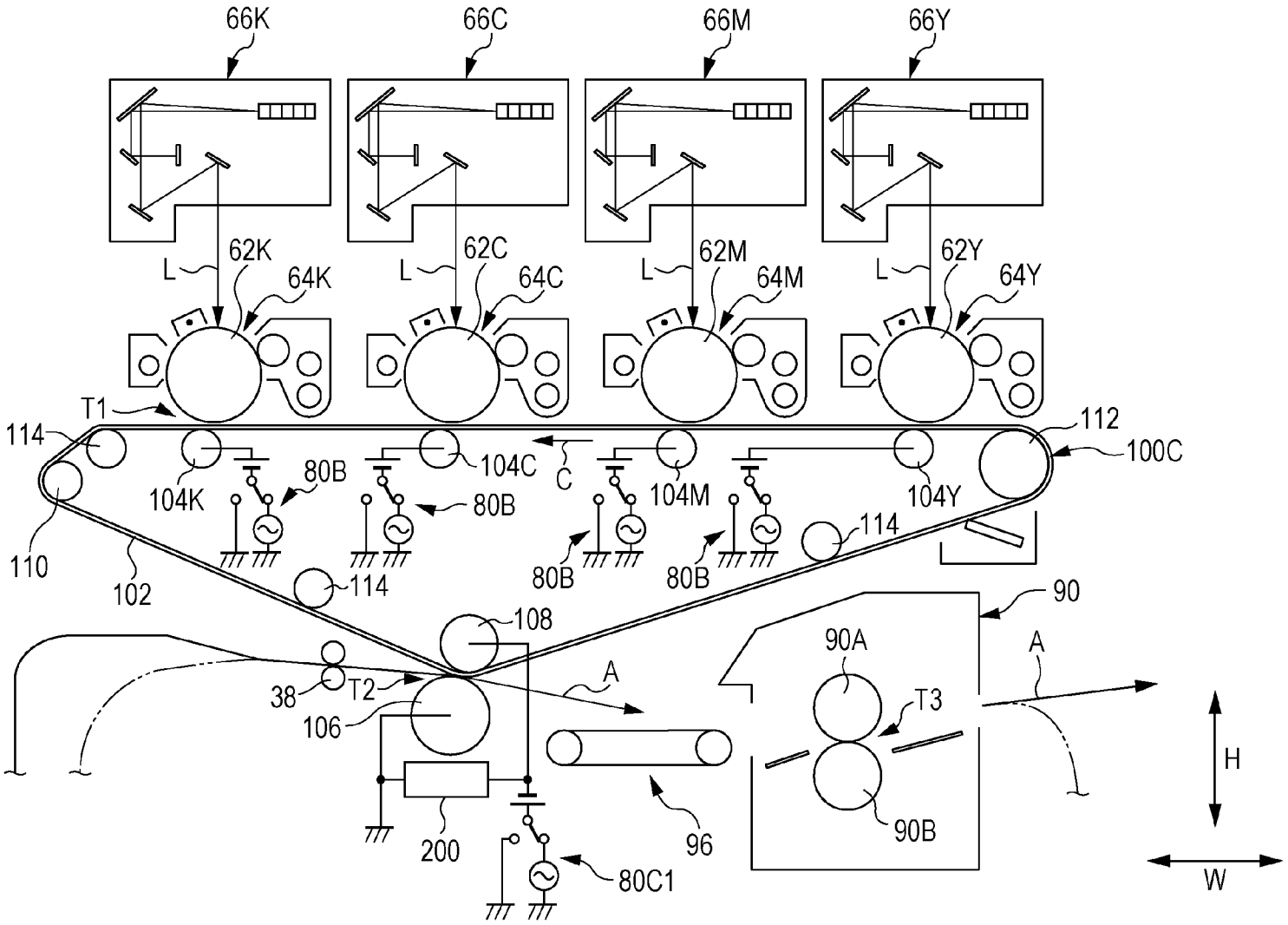
FIG. 6 schematically illustrates an image forming section included in an image forming apparatus according to a third exemplary embodiment.

FIG. 6 is a schematic front view of an image forming section 14 included in an image forming apparatus 10C (corresponding to the image forming apparatus 10 illustrated in FIG. 1) according to the third exemplary embodiment. A transfer device 100C includes an electrical-resistance-measuring device 200. The electrical-resistance-measuring device 200 measures the electrical resistance of the second-transfer unit 120.

In the third exemplary embodiment, if the third mode is selected for the transfer device 100C, the temperature and the humidity in the image forming apparatus 10C are measured before the toner images on the outer peripheral surfaces of the respective photoconductor drums 62 are transferred to the transfer belt 102. Furthermore, in the third exemplary embodiment, in accordance with the timing of measurement of the temperature and the humidity in the image forming apparatus 10C, the electrical-resistance-measuring device 200 measures the electrical resistance obtained when a current of 100 μA, for example, is supplied to the second-transfer unit 120. Subsequently, in accordance with the measured temperature and humidity and the measured electrical resistance of the second-transfer unit 120, the transfer device 100C changes at least one of the amplitude of ½ Vpp and the frequency T of the alternating-current voltage to be applied to the counter roller 108 by the second-transfer power supply 80C1. Furthermore, the transfer device 100C changes at least one of the amplitude of ½ Vpp and the frequency T of the alternating-current voltage to be applied to each of the first-transfer rollers 104 by a corresponding one of the first-transfer power supplies 80B.

Specifically, the transfer device 100C has a regression equation (or a table) that determines the amplitude of ½ Vpp and the frequency T of the alternating-current voltage to be applied to each of the first-transfer rollers 104. The amplitude of ½ Vpp and the frequency T are determined in accordance with the electrical resistance of the second-transfer unit 120 that is provided for each of different values of the temperature and the humidity in the image forming apparatus 10C. In accordance with the measured temperature, the measured humidity, and the measured electrical resistance, the transfer device 100C determines and changes the amplitude of ½ Vpp and the frequency T of the alternating-current voltage to be applied to each of the first-transfer rollers 104 on the basis of the regression equation.

In the regression equation, as the measured electrical resistance becomes larger, the amplitude of ½ Vpp of the alternating-current voltage is made larger and/or the frequency T of the alternating-current voltage is made shorter. Furthermore, in the regression equation, as the measured electrical resistance becomes smaller, the amplitude of ½ Vpp of the alternating-current voltage is made smaller and/or the frequency T of the alternating-current voltage is made longer.

While the electrical-resistance-measuring device 200 is configured to measure the electrical resistance of the second-transfer unit 120, the electrical resistance may be calculated from the values of the voltage and the current in the second-transfer unit 120.

Third Exemplary Embodiment

In the transfer device 100C according to the third exemplary embodiment, at least one of the amplitude of ½ Vpp and the frequency T of the alternating-current voltage to be applied to the counter roller 108 by the second-transfer power supply 80C1 is changed in accordance with the measured electrical resistance of the second-transfer unit 120. Furthermore, in accordance with the changed amplitude or frequency or the changed amplitude and frequency of the alternating-current voltage to be applied by the second-transfer power supply 80C1, either the amplitude or the frequency or both the amplitude and the frequency of the alternating-current voltage to be applied by each first-transfer power supply 80B are also changed.

Hence, in the transfer device 100C, it is less likely that the amplitude of ½ Vpp of the alternating-current voltage to be applied by the first-transfer power supply 80B will become too large or the frequency T of the alternating-current voltage will become too short.

Therefore, in the transfer device 100C according to the third exemplary embodiment, the occurrence of unnecessary discharge during the first transfer is more suppressed in accordance with the electrical resistance of the second-transfer unit 120 than in a case where none of the amplitude and the frequency of the alternating-current voltage to be applied during the first transfer are not changed.

The other operations are the same as in the above exemplary embodiments.

Fourth Exemplary Embodiment

Configuration According to Fourth Exemplary Embodiment

Figure 7:
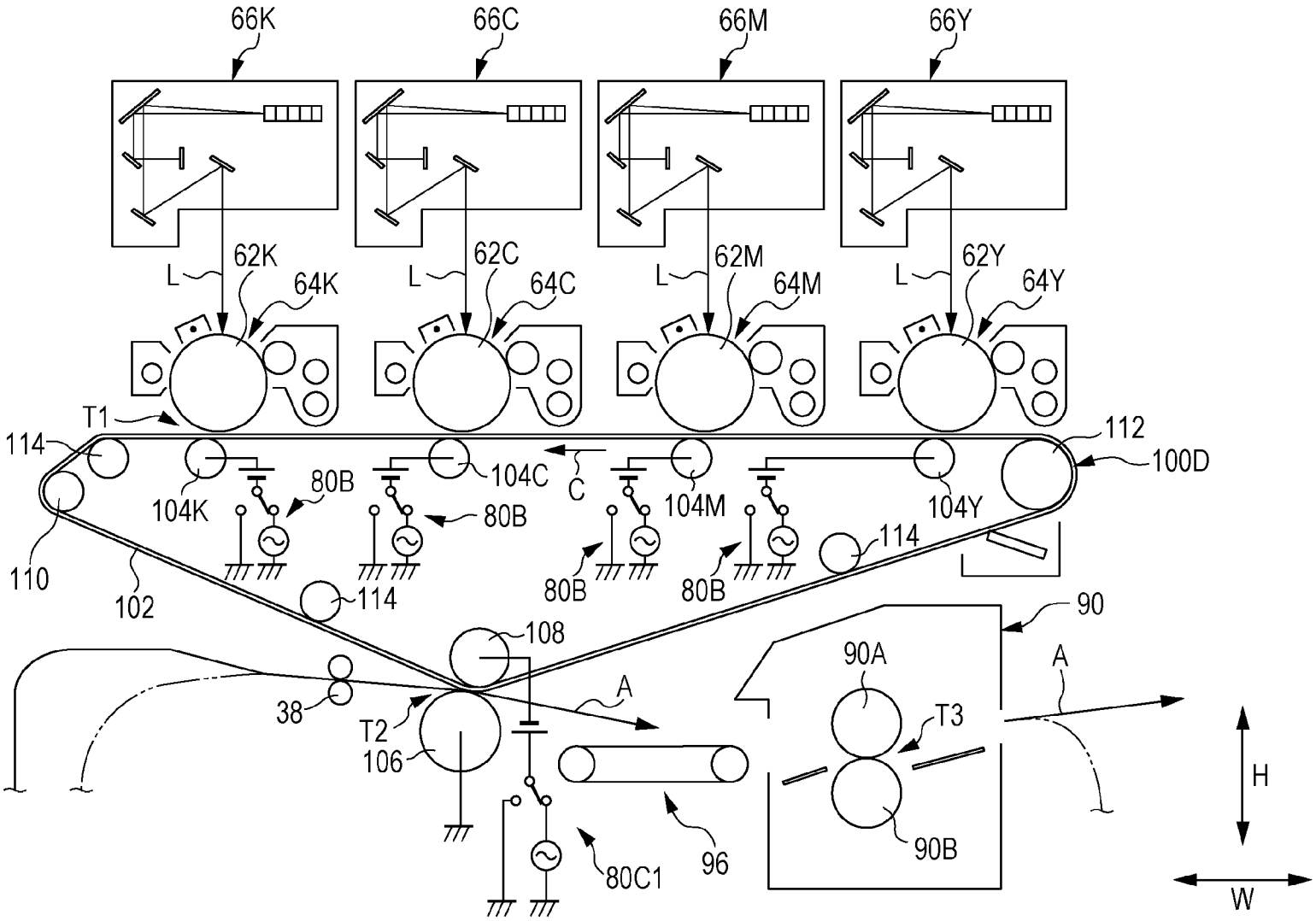
FIG. 7 schematically illustrates an image forming section included in an image forming apparatus according to a fourth exemplary embodiment.

A fourth exemplary embodiment of the present invention will now be described with reference to FIG. 7, focusing on differences from the above exemplary embodiments. Elements (components and so forth) that are the same as in any of the above exemplary embodiments are denoted by corresponding ones of the reference numerals used therein.

In a transfer device 100D according to the fourth exemplary embodiment, a direct-current voltage and an alternating-current voltage are applied to the first-transfer roller 104 that transfers one of the toner images to be transferred that is on the most downstream side in the direction of rotation of the transfer belt 102 by a corresponding one of the first-transfer power supplies 80B. Meanwhile, only a direct-current voltage is applied to each of the other first-transfer rollers 104 that are on the upstream with respect to the foregoing first-transfer roller 104 side in the direction of rotation of the transfer belt 102 by a corresponding one of the other first-transfer power supplies 80B. That is, in the transfer device 100D, the alternating-current mode is used for one of the first-transfer rollers 104 that lastly transfers a toner image to the transfer belt 102 (this mode is hereinafter referred to as modified first mode).

An image forming apparatus 10D (corresponding to the image forming apparatus 10 illustrated in FIG. 1) according to the fourth exemplary embodiment forms toner images in the respective colors of yellow (Y), magenta (M), cyan (C), and black (K). For example, in a case where toner images in the four respective colors are to be transferred, the first-transfer roller 104 that transfers one of the toner images that is on the most downstream side in the direction of rotation of the transfer belt 102 is the first-transfer roller 104K. In this case, the first-transfer roller 104K is an exemplary first-transfer member that lastly transfers the toner image.

In a case where toner images in three respective colors of yellow (Y), magenta (M), and cyan (C) are to be transferred, the first-transfer roller 104 that transfers one of the toner images that is on the most downstream side in the direction of rotation of the transfer belt 102 is the first-transfer roller 104C. In this case, the first-transfer roller 104C functions an exemplary first-transfer member that lastly transfers the toner image.

Thus, which one of the first-transfer members lastly transfers the toner image is determined by the combination of plural toners that are necessary for forming a combination of toner images to be transferred.

If the modified first mode is used, the second-transfer efficiency is improved more than in the second mode and the toner consumption is reduced correspondingly (see FIG. 17), which will be described separately below. Hence, if the user selects an option for reducing the toner consumption on the UI, the transfer device 100D operates in the modified first mode.

Fourth Exemplary Embodiment

The following description is based on an exemplary case where toner images in the four respective colors of yellow (Y), magenta (M), cyan (C), and black (K) are to be transferred.

If a fourth mode is selected for the transfer device 100D, only a direct-current voltage is applied to each of the first-transfer rollers 104Y, 104M, and 104C by a corresponding one of the first-transfer power supplies 80B in accordance with the timing of the first transfer performed by the first-transfer rollers 104Y, 104M, and 104C. Thus, toner images in the respective colors of yellow (Y), magenta (M), and cyan (C) are sequentially transferred to the transfer belt 102 at the respective first-transfer nips T1.

The toner images in the three respective colors thus transferred to the transfer belt 102 are transported toward the first-transfer nip T1for the black (K) toner image (hereinafter referred to as first-transfer nip T1K) while adhering to the transfer belt 102 with larger forces than in a case where those toner images are transferred with alternating-current voltages.

While the toner images in the three respective colors transferred to the transfer belt 102 pass through the first-transfer nip T1K, the black (K) toner image formed on the photoconductor drum 62K is transferred to the transfer belt 102.

During the first transfer of the black (K) toner image, the toner images in the other colors already transferred are transported while each being subject to a force that alternates between the two directions in the form of a rectangular wave (see FIG. 4) at the first-transfer nip T1K and in the gaps on the upstream side and the downstream side of the first-transfer nip T1K.

Thus, the forces with which the toner images in the respective colors that have passed through the first-transfer nip T1K adhere to the transfer belt 102 become smaller than before passing through the first-transfer nip T1K.

Hence, in the transfer device 100D according to the fourth exemplary embodiment, the forces of adhesion of those toner images that have been transferred to the transfer belt 102 only with direct-current voltages are smaller than in the case where all toner images in plural colors are transferred to a transfer belt only with direct-current voltages.

The other operations are the same as in the above exemplary embodiments.

Fifth Exemplary Embodiment

Configuration According to Fifth Exemplary Embodiment

A fifth exemplary embodiment of the present invention will now be described with reference to FIGS. 8 and 9, focusing on differences from the above exemplary embodiments. Elements (components and so forth) that are the same as in any of the above exemplary embodiments are denoted by corresponding ones of the reference numerals used therein.

Figure 8:
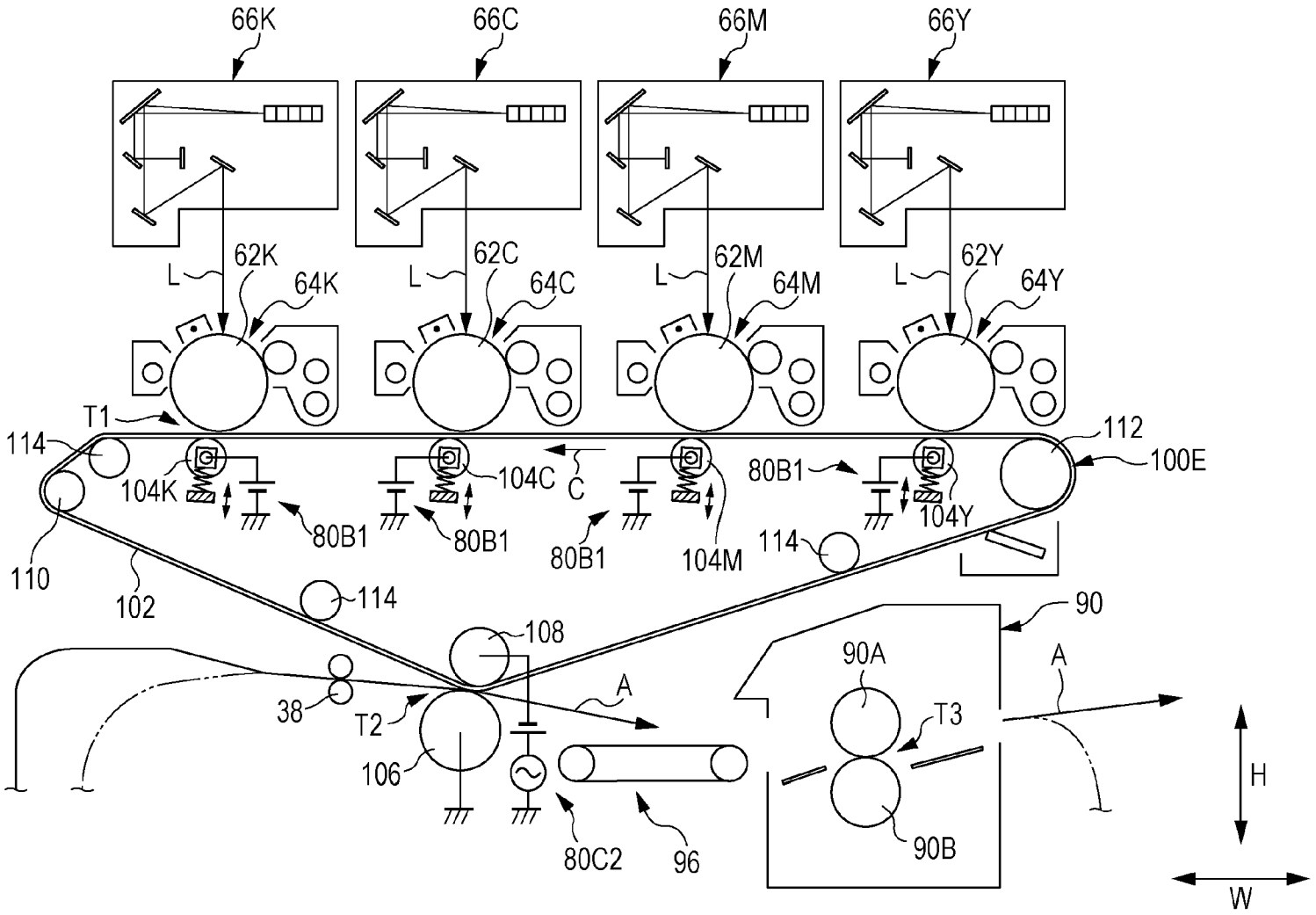
FIG. 8 schematically illustrates an image forming section included in an image forming apparatus according to a fifth exemplary embodiment.
Figure 9:
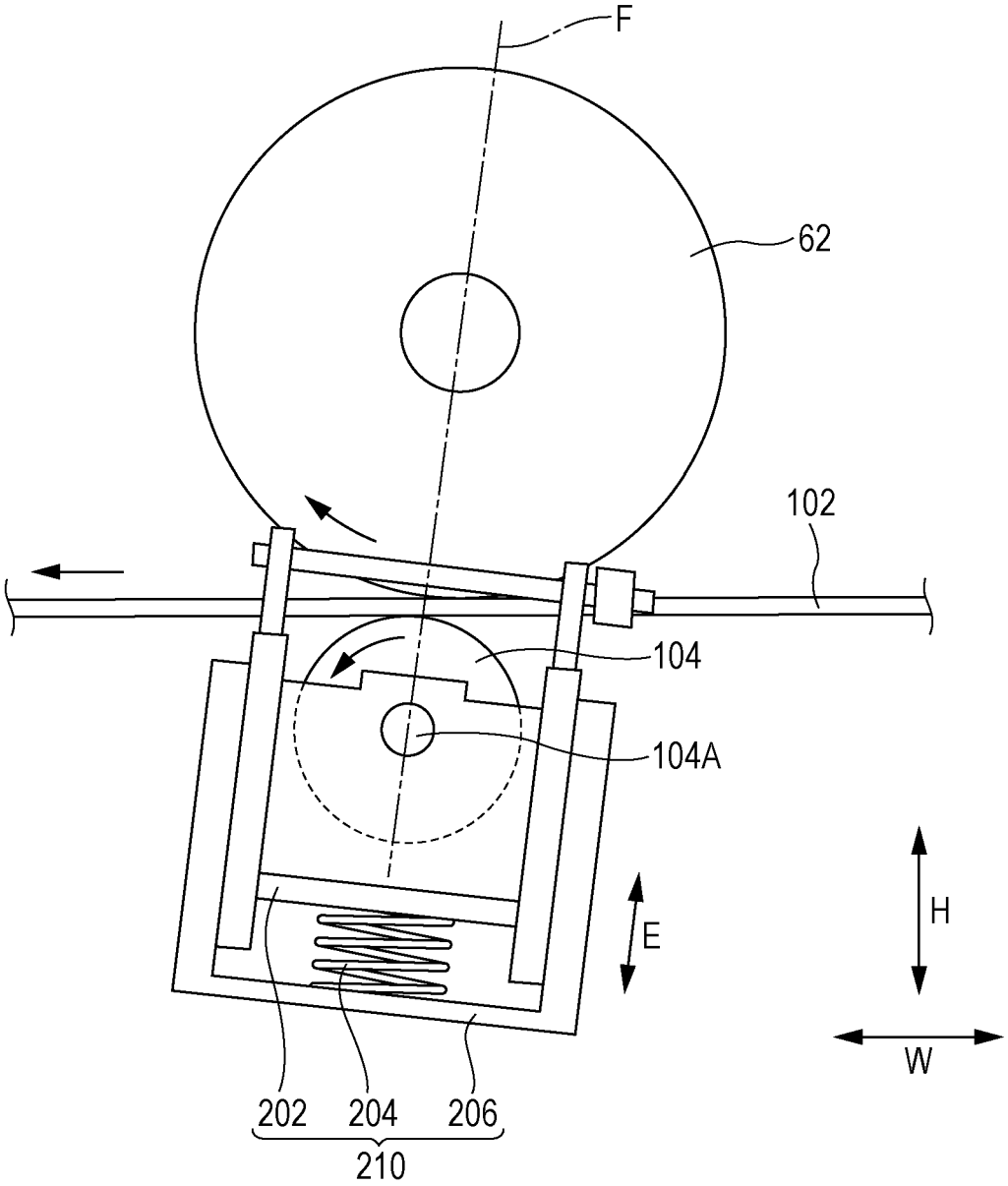
FIG. 9 schematically illustrates part of one of toner-image-forming units, a corresponding one of first-transfer rollers, and peripheral elements according to the fifth exemplary embodiment.

FIG. 8 is a schematic front view of an image forming section 14 included in an image forming apparatus 10E according to the fifth exemplary embodiment. FIG. 9 is a schematic diagram illustrating one of the toner-image-forming units 64, a corresponding one of the first-transfer rollers 104, and peripheral elements according to the fifth exemplary embodiment.

A transfer device 100E according to the fifth exemplary embodiment includes first-transfer power supplies 80E1 instead of the first-transfer power supplies 80B. Furthermore, the transfer device 100E includes a second-transfer power supply 80C2 instead of the second-transfer power supply 80C or 80C1. The first-transfer power supplies 80B1 each apply only a direct-current voltage to a corresponding one of the first-transfer rollers 104. The second-transfer power supply 80C2 applies an alternating-current voltage to the counter roller 108.

Furthermore, the transfer device 100E includes a pair of pressing-force-changing units 210 provided for each of the first-transfer rollers 104. The pair of pressing-force-changing units 210 is capable of changing the force with which the first-transfer roller 104 presses the transfer belt 102. FIG. 9 is a front view of one of the pressing-force-changing unit 210. The pressing-force-changing unit 210 is an exemplary pressing-force-changing member.

The pressing-force-changing unit 210 includes a first holder 202, a compression spring 204, and a second holder 206. The first holder 202 functions as a bearing for a rotating shaft 104A of the first-transfer roller 104. The compression spring 204 is held in a compressed state between the first holder 202 and the second holder 206. The second holder 206 holds the first holder 202 and is movable in a direction (indicated by arrow E) along a virtual line F that connects the center of rotation of the photoconductor drum 62 and the center of rotation of the first-transfer roller 104.

The compression spring 204 presses the first-transfer roller 104 held by the first holder 202 toward the photoconductor drum 62 along the virtual line F. The second holder 206 is movable in the direction of arrow E, thereby being capable of changing the amount of compression of the compression spring 204 (the length by which the compression spring 204 is compressed from its natural length).

In the transfer device 100E, the pressing-force-changing unit 210 changes the force with which the first-transfer roller 104 presses the transfer belt 102 in accordance with the type of the recording medium P to which the toner images are to be transferred. Specifically, in the transfer device 100E, the pressing force exerted by the first-transfer roller 104 in the second transfer to a piece of embossed paper is made smaller than the pressing force exerted by the first-transfer roller 104 in the second transfer to a piece of plain paper (the latter force will be hereinafter referred to as reference pressing force). The transfer device 100E selectively operates between an A1 mode for the second transfer to a piece of plain paper in which the pressing force exerted by the first-transfer roller 104 is equal to the reference pressing force and an A2 mode for the second transfer to a piece of embossed paper in which the pressing force exerted by the first-transfer roller 104 is smaller than the reference pressing force. The transfer device 100E operates in the A2 mode if the user selects embossed paper on the UI, or in the A1 mode if the user selects plain paper on the UI.

In the transfer device 100E, if the A1 mode is selected, the second holder 206 is moved to a reference position where the pressing force exerted on the transfer belt 102 by the first-transfer roller 104 becomes equal to the reference pressing force. The term "reference position" refers to a position of the second holder 206 that is predetermined with respect to the photoconductor drum 62 for the first transfer to a piece of plain paper.

In the transfer device 100E, if the A2 mode is selected, the second holder 206 is moved such that the pressing force exerted by the first-transfer roller 104 becomes smaller than the reference pressing force. Specifically, in the transfer device 100E, the second holder 206 is movable along the virtual line F to a predetermined position that is farther from the photoconductor drum 62 than the reference position.

Fifth Exemplary Embodiment

If the A2 mode is selected for the transfer device 100E according to the fifth exemplary embodiment, the second holder 206 is moved along the virtual line F to the predetermined position that is farther from the photoconductor drum 62 than the reference position. Accordingly, the pressing force exerted on the transfer belt 102 by the first-transfer roller 104 becomes smaller than the reference pressing force. In such a case, the toner pressed at the first-transfer nip T1tends to be less squashed (deformed) by the pressing than the toner pressed at the reference pressing force. That is, the toner pressed at the first-transfer nip T1has a smaller area of contact with the transfer belt 102 than the toner pressed with the reference pressing force. Hence, the toner pressed at the first-transfer nip T1adheres to the transfer belt 102 with a smaller force than the toner pressed with the reference pressing force.

Here, as a fourth comparative embodiment, suppose that a toner image is transferred to a transfer belt with only a direct-current voltage being applied to the first-transfer roller that is at the reference position, and the toner image is then transferred to a piece of embossed paper with a direct-current voltage and an alternating-current voltage being applied to the counter roller. In such a case, the toner that has been transferred to the transfer belt adheres to the transfer belt with a larger force than in the A2 mode.

In contrast, in the A2 mode, the amplitude of the alternating-current voltage to be applied when the transferred toner image is further transferred to a piece of embossed paper is smaller than in the fourth comparative embodiment.

Hence, in the transfer device 100E according to the fifth exemplary embodiment, the scattering of toner on a piece of embossed paper is suppressed more than in the fourth comparative embodiment.

Furthermore, in the image forming apparatus 10E according to the fifth exemplary embodiment, the occurrence of failure in image formation due to the scattering of toner on a piece of embossed paper is suppressed more than in the fourth comparative embodiment.

The other operations are the same as in the above exemplary embodiments.

Modification of Fifth Exemplary Embodiment

Configuration According to Modification of Fifth Exemplary Embodiment

A modification of the fifth exemplary embodiment will now be described with reference to FIGS. 10A, 10B, and 11, focusing on differences from the fifth exemplary embodiment. Elements (components and so forth) that are the same as in the fifth exemplary embodiment are denoted by corresponding ones of the reference numerals used therein.

Figure 10A:
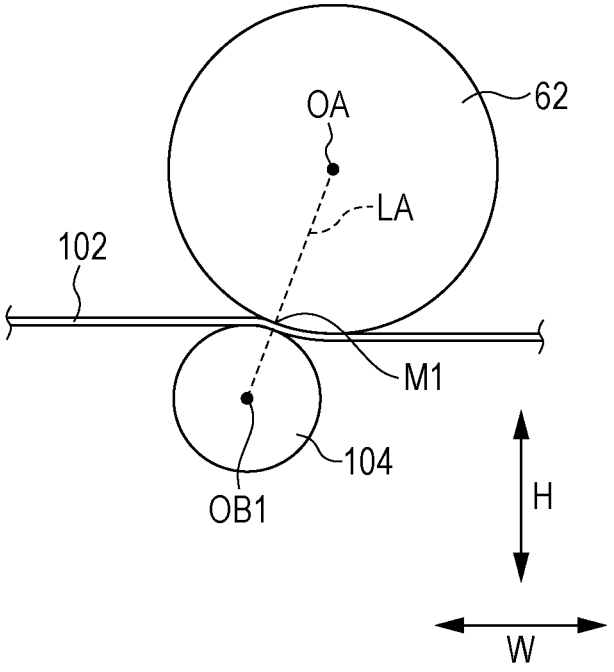
FIG. 10A schematically illustrates part of a toner-image-forming unit, a first-transfer roller, and a peripheral element according to a modification of the fifth exemplary embodiment that are in contact with one another when a first transfer is performed on a piece of plain paper.
Figure 10B:
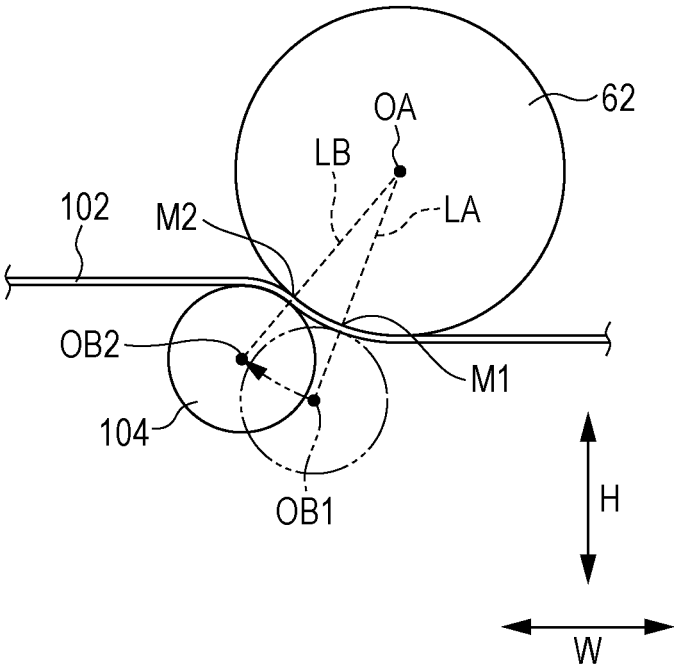
FIG. 10B schematically illustrates the part of the toner-image-forming unit, the first-transfer roller, and the peripheral element according to the modification of the fifth exemplary embodiment that are in contact with one another when the first transfer is performed on a piece of embossed paper.

FIGS. 10A and 10B are schematic diagrams each illustrating a first-transfer roller 104 and peripheral elements (part of a transfer device 100F) included in a toner-image-forming unit 64 according to the modification of the fifth exemplary embodiment. FIG. 10A illustrates the positional relationship between the photoconductor drum 62 and the first-transfer roller 104 in the first transfer to a piece of plain paper. FIG. 10B illustrates the positional relationship between the photoconductor drum 62 and the first-transfer roller 104 in the first transfer to a piece of embossed paper.

In the transfer device 100F according to the fifth exemplary embodiment, the position of the first-transfer roller 104 with respect to the photoconductor drum 62 is changeable. Specifically, the first-transfer roller 104 is rotatable about an axis of rotation OA of the photoconductor drum 62.

The transfer device 100F includes a position changing unit 220 that changes the position of the first-transfer roller 104, which is configured to press the transfer belt 102, in accordance with the type of the recording medium P on which the toner image is to be transferred. That is, the position of the first-transfer roller 104 is changeable by the position changing unit 220. Specifically, in the transfer device 100F, a position of the first-transfer roller 104 taken in the second transfer to a piece of embossed paper (represented by the solid line in FIG. 10B) is displaced, in a clockwise direction in front view seen in the apparatus depth direction, with respect to a position of the first-transfer roller 104 taken in the second transfer to a piece of plain paper (represented by the dash-dot-dot line in FIG. 10B and hereinafter referred to as reference position 2). In the transfer device 100F, the length of contact (the length of wrapping) of the transfer belt 102 with the outer peripheral surface of the photoconductor drum 62 is changed by displacing the first-transfer roller 104 as described above. Herein, the term "the length of contact" refers to the circumferential length of an area where the transfer belt 102 is in contact with the outer peripheral surface of the photoconductor drum 62. In addition, the position changing unit 220 is an exemplary pressing-force-changing member.

Referring to FIGS. 10A and 10B, the center of rotation of the first-transfer roller 104 in the second transfer to a piece of plain paper is denoted by OB1, the center of rotation of the first-transfer roller 104 in the second transfer to a piece of embossed paper is denoted by OB2, the center of rotation of the photoconductor drum 62 is denoted by OA, the line connecting the center OA and the center OB1 is denoted by LA, the line connecting the center OA and the center OB2 is denoted by LB, and, when seen from the front side in the apparatus depth direction, the intersections between the outer peripheral surface of the photoconductor drum 62 and the lines LA and LB are denoted by M1 and M2, respectively. In such a case, the length of contact when the first-transfer roller 104 is at the position taken in the second transfer to a piece of embossed paper is larger than in the case where the first-transfer roller 104 is at the reference position 2 by the circumferential length of the photoconductor drum 62 from the intersection M1 to the intersection M2.

The transfer device 100F has a B1 mode in which the second transfer to a piece of plain paper is performed with the first-transfer roller 104 being at the reference position 2, and a B2 mode in which the second transfer to a piece of embossed paper is performed with a length of contact that has been increased by a predetermined length by moving the first-transfer roller 104. The transfer device 100F operates in the B2 mode if the user selects embossed paper on the UI, or in the B1 mode if the user selects plain paper on the UI.

Figure 11:
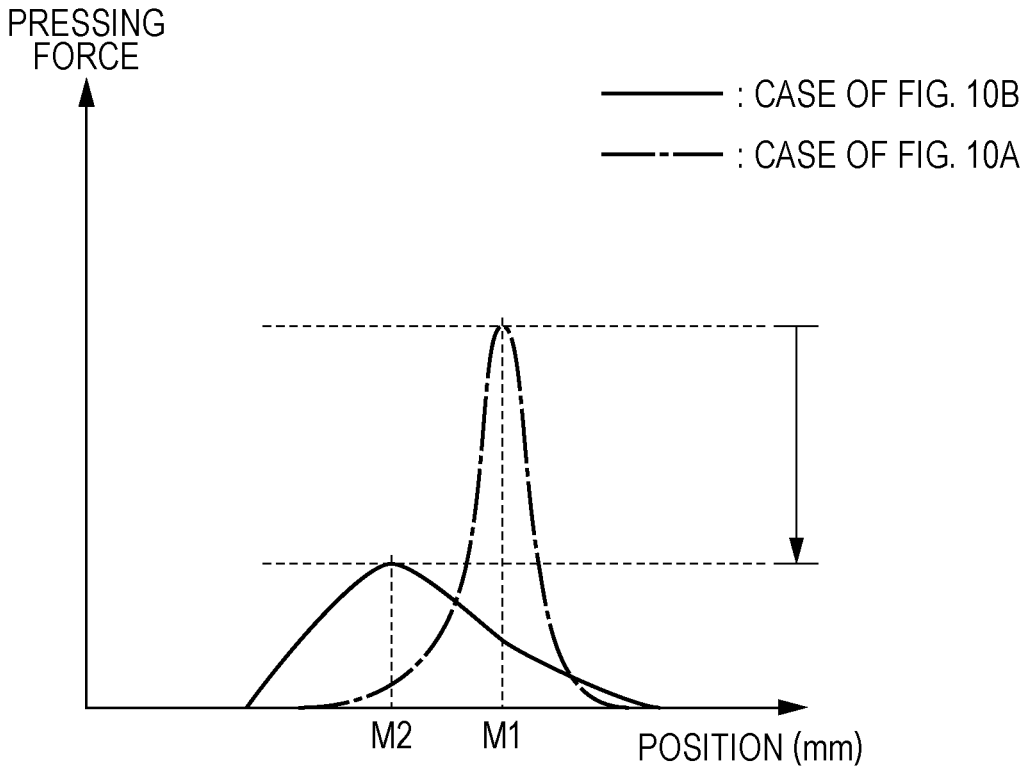
FIG. 11 is a graph illustrating the relationship between the position of the first-transfer roller according to the modification of the fifth exemplary embodiment with respect to an image carrier and the load applied to the image carrier.

FIG. 11 is a graph illustrating the distribution of the pressing force that the first-transfer roller 104 applies to the outer peripheral surface of the photoconductor drum 62 with the transfer belt 102 interposed therebetween in the situation illustrated in FIG. 10A and in the situation illustrated in FIG. 10B. According to the graph in FIG. 11, the pressing force is more locally applied to the transfer belt 102 in the B1 mode than in the B2 mode. In other words, the pressing force applied to the transfer belt 102 is smaller in the B2 mode than in the B1 mode. Note that the transfer device 100F employs a constant-load method (a method in which the spring load applied to the first-transfer roller 104 does not change even if the position of the first-transfer roller 104 is changed). Therefore, the areas defined by the two curves in the graph illustrated in FIG. 11 are the same as each other.

Modification of Fifth Exemplary Embodiment

The operations performed in the modification are the same as in the fifth exemplary embodiment.

The pressing-force-changing unit 210 according to the fifth exemplary embodiment and the position changing unit 220 according to the modification thereof each function so as to change the force with which the toner image that has been transferred to the transfer belt 102 adheres to the transfer belt 102. That is, the pressing-force-changing unit 210 and the position changing unit 220 each have the same function as the first-transfer power supply 80B according to any of the first to fourth exemplary embodiments that applies an alternating-current voltage and a direct-current voltage to the first-transfer roller 104. Hence, the pressing-force-changing unit 210 according to the fifth exemplary embodiment or the position changing unit 220 according to the modification thereof may also be applied to any of the first to fourth exemplary embodiments instead of the first-transfer power supply 80B. The operations in such a case are the same as above.

While specific exemplary embodiments of the present invention have been described in detail, the present invention is not limited to the above exemplary embodiments. Various other exemplary embodiments are available within the scope of the present invention.

The above description concerns a case where the alternating-current voltage applied to the first-transfer roller 104 by the first-transfer power supply 80B has a rectangular waveform. The voltage does not necessarily have such a rectangular waveform and may have a sinusoidal waveform, a triangular waveform, or the like. Moreover, the voltage may have a waveform obtained as a combination of the foregoing waveforms. The same applies to the alternating-current voltage applied to the counter roller 108 by the second-transfer power supply 80C1.

EXAMPLES

Working Examples 1 to 5 and Comparative Examples 1 to 4 will now be described with reference to associated drawings. FIG. 13 is a table summarizing conditions set forth for evaluations conducted on Working Examples 1 to 5 and Comparative Examples 1 to 4 described below.

Working Examples of First to Fourth Exemplary Embodiments and Comparative Examples Apparatuses to be Evaluated Evaluations conducted on Working Examples 1 to 3 and Comparative Examples 1 to 3 will now be described.

Basic Configurations of Image Forming Apparatuses to be Evaluated

An evaluation is conducted by varying the conditions of the image forming apparatus 10.

The evaluation is conducted with embossed paper (Leathac 66 (a registered trademark), 250 gsm).

The processing speed (for embossed paper), i.e., the speed of transport, is 440 mm/s.

The transfer belt 102 includes two layers. A layer on the outer peripheral side has a thickness of 67 μm. A layer on the inner peripheral side has a thickness of 33 μm. The two layers are both made of polyimide with carbon black scattered therein. The volume resistivity of the transfer belt 102 is 12.5 log Ω·cm. The surface resistivity on the inner peripheral side of the transfer belt 102 is 10.3 log Ω/sq. The volume resistivity and the surface resistivity are measured with a digital ultra-high-resistance/microampere meter R8340A (manufactured by Advantest Corporation) and a UR probe MCP-HTP12 (manufactured by DIA Instruments Co., Ltd.). The measurement is performed in an environment at a temperature of 22° C. and with a humidity of 55%. The volume resistivity is measured by applying a load of 19.6 N and a voltage of 500 V to the transfer belt 102 for 10 seconds.

The counter roller 108 has a diameter of 20 mm, a volume resistance of 6.5 log·Ω, and an Asker C hardness of 65 degrees. The second-transfer roller 106 has a diameter of 24 mm, a volume resistance of 7.0 log·Ω, and an Asker C hardness of 75 degrees. The evaluation is conducted at a temperature of 22° C. and with a humidity of 55%.

Items to be Evaluated

Basically, the following two items are evaluated.

Evaluation of Transferability

In the evaluation of transferability, a solid image is transferred to a piece of recording medium P, and whether or not the image is properly transferred is evaluated.

Figure 12:
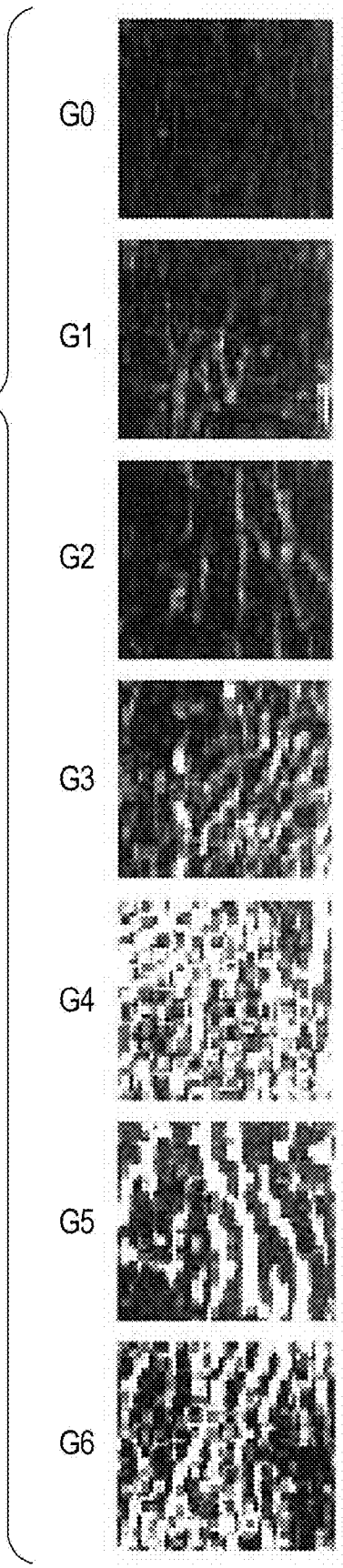
FIG. 12 illustrates different grades of the transferability of toner that has been transferred to a piece of embossed paper.

Specifically, as illustrated in FIG. 12, the transferability is graded from G0 to G6. Grades of transferability of G3 and higher are regarded as good. The evaluation is based on visual inspection.

Evaluation of Scattering of Toner

In the evaluation of scattering of toner, a grid-pattern image as a toner image is transferred to a piece of recording medium P, and the degree of scattering of toner from the grid-pattern image that has been transferred to the piece of recording medium P is evaluated. Specifically, the result illustrated in FIG. 14A is regarded as good, whereas the result illustrated in FIG. 14B is regarded as failure. This evaluation is also based on visual inspection.

Working Example 1

Conditions set forth for the evaluation conducted on Working Example 1 are summarized in FIG. 13. The results of the evaluation are summarized in FIGS. 16A and 16B.

Working Example 2

Conditions set forth for the evaluation conducted on Working Example 2 are summarized in FIG. 13. In Working Example 2, a first-transfer voltage defined in FIG. 13 is applied to each of all first-transfer rollers 104.

Working Example 3

Conditions set forth for the evaluation conducted on Working Example 3 are summarized in FIG. 13. In Working Example 3, unlike Working Example 2, a first-transfer voltage defined in FIG. 13 is applied only to the first-transfer roller 104K (for black (K)) that is on the most downstream side in the direction of rotation of the transfer belt 102. A direct-current voltage of 1.8 kV is applied to each of the other first-transfer rollers 104Y, 104M, and 104C.

Comparative Example 1

Conditions set forth for the evaluation conducted on Comparative Example 1 are summarized in FIG. 13. The results of the evaluation are graphed in FIG. 17.

Comparative Example 2

Conditions set forth for the evaluation conducted on Comparative Example 2 are summarized in FIG. 13. The result of the evaluation are illustrated in FIG. 14B.

Comparative Example 3

Conditions set forth for the evaluation conducted on Comparative Example 3 are summarized in FIG. 13. The results of the evaluation are summarized in FIGS. 15A and 15B.

Review

The results of the evaluations conducted on Working Examples 1 to 3 and Comparative Examples 1 and 2 will now be reviewed.

In FIG. 14B illustrating the result of the evaluation conducted on Comparative Example 2, apparent scattering of toner is seen (reference character Ts denotes scattered toner). In contrast, in FIG. 14A illustrating the result of the evaluation conducted on any of Working Examples 1 to 5 (Working Examples 4 and 5 will be described separately below), the scattering of toner is suppressed.

As summarized in FIGS. 15A and 15B, none of the conditions set forth for Comparative Example 3 meet the criteria of the evaluation of transferability and the evaluation of scattering of toner. Therefore, Comparative Example 3 is regarded as failure.

As summarized in FIGS. 16A and 16B, Working Example 1 is regarded as good for all of the conditions set forth for the two evaluations. The alternating-current voltage applied to the second-transfer unit 120 in Working Example 1 (see FIG. 16A) is smaller than in Comparative Example 3 (see FIG. 15A). Therefore, Working Example 1 is regarded as good in the evaluation of transferability. Furthermore, the alternating-current voltage applied to the second-transfer unit 120 in Working Example 1 (see FIG. 16B) is smaller than in Comparative Example 3 (see FIG. 15B). Therefore, Working Example 1 is regarded as good in the evaluation of scattering of toner.

Referring to FIG. 17 illustrating the results of Working Examples 2 and 3 and Comparative Example 1, the second-transfer efficiency in Working Examples 2 and 3 is higher than in Comparative Example 1. That is, it is understood that the second-transfer efficiency is improved by applying an alternating-current voltage to all of the first-transfer rollers or to one of the first-transfer rollers 104 that is on the most downstream side in the direction of rotation of the transfer belt 102.

Working Examples According to Modification of Fifth Exemplary Embodiment and Comparative Examples Apparatuses to be Evaluated Evaluations conducted on Working Examples 4 and 5 and Comparative Example 4 will now be described.

Basic Configurations of Image Forming Apparatuses to be Evaluated

Basically, the image forming apparatuses to be evaluated have the same configurations as described above, except that only a direct-current voltage is applied to each of the first-transfer rollers 104 and that the image forming apparatuses each include the pressing-force-changing unit 210 or the position changing unit 220.

Working Example 4

Conditions set forth for the evaluation conducted on Working Example 4 are summarized in FIG. 13. The results of the evaluation are summarized in FIGS. 19A and 193. In Working Example 4, the pressing force applied to the transfer belt 102 is changed to 39.2 gN/cm (the reference pressing force is 147 gN/cm) by the pressing-force-changing unit 210.

Working Example 5

Conditions set forth for the evaluation conducted on Working Example 5 are summarized in FIG. 13. The results of the evaluation are summarized in FIGS. 20A and 20B. In Working Example 5, the length of contact between the transfer belt 102 and the photoconductor drum 62 is changed by 3 mm with respect to the reference position 2 by the position changing unit 220.

Comparative Example 4

Conditions set forth for the evaluation conducted on Comparative Example 4 are summarized in FIG. 13. The results of the evaluation are summarized in FIGS. 18A and 18B. In Comparative Example 4, the pressing force applied to the transfer belt 102 is set to the reference pressing force (147 gN/cm) by the pressing-force-changing unit 210.

Review

The results of the evaluations conducted on Working Examples 4 and 5 and Comparative Example 4 will now be reviewed.

As summarized in FIGS. 18A and 18B, none of the conditions set forth for Comparative Example 4 meet the criteria of the evaluation of transferability and the evaluation of scattering of toner. Therefore, Comparative Example 4 is regarded as failure.

As summarized in FIGS. 19A and 19B, Working Example 4 is regarded as good for all of the conditions set forth for the two evaluations. The alternating-current voltage applied to the second-transfer unit 120 in Working Example 4 (see FIG. 19A) is smaller than in Comparative Example 4 (see FIG. 18A). Therefore, Working Example 4 is regarded as good in the evaluation of transferability. Furthermore, the alternating-current voltage applied to the second-transfer unit 120 in Working Example 4 (see FIG. 19B) is smaller than in Comparative Example 4 (see FIG. 18B). Therefore, Working Example 4 is regarded as good in the evaluation of scattering of toner.

As summarized in FIGS. 20A and 20B, Working Example 5 is regarded as good for all of the conditions set forth for the two evaluations. The alternating-current voltage applied to the second-transfer unit 120 in Working Example 5 (see FIG. 20A) is smaller than in Comparative Example 4 (see FIG. 18A). Therefore, Working Example 5 is regarded as good in the evaluation of transferability. Furthermore, the alternating-current voltage applied to the second-transfer unit 120 in Working Example 5 (see FIG. 20B) is smaller than in Comparative Example 4 (see FIG. 18B). Therefore, Working Example 5 is regarded as good in the evaluation of scattering of toner.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a first-transfer power supply that includes a direct-current power supply and an alternating-current power supply;

a first-transfer member that transfers a toner image formed on an outer peripheral surface of an image carrier to a receiving member, the first-transfer member transferring the toner image by receiving a voltage from the first-transfer power supply; and a second-transfer member that transfers the toner image transferred to the receiving member to a medium, wherein the first-transfer power supply is capable of operating at (1) a first mode of applying an alternating-current voltage to the first-transfer member, and (2) a second mode of applying only a direct-current voltage to the first-transfer member.

2. The transfer device according to claim 1, further comprising:

a second-transfer power supply that includes a direct-current power supply and an alternating-current power supply, wherein the second-transfer member transfers the toner image transferred to the receiving member to the medium by receiving a voltage from the second-transfer power supply.

3. The transfer device according to claim 1, wherein the first-transfer power supply is selectively operable between an alternating-current mode in which an alternating-current voltage is applied to the first-transfer member and a direct-current mode in which only a direct-current voltage is applied to the first-transfer member.

4. The transfer device according to claim 2, wherein the first-transfer power supply is selectively operable between an alternating-current mode in which an alternating-current voltage is applied to the first-transfer member and a direct-current mode in which only a direct-current voltage is applied to the first-transfer member.

5. The transfer device according to claim 4, wherein the alternating-current mode is selected if the toner image is transferred to a medium having higher surface unevenness than predetermined reference surface unevenness.

6. The transfer device according to claim 5, wherein at least one of an amplitude and a frequency of the alternating-current voltage is changed in accordance with a degree of surface unevenness of the medium.

7. The transfer device according to claim 5, wherein at least one of an amplitude and a frequency of the alternating-current voltage is changed in accordance with a value of electrical resistance of the second-transfer member.

8. The transfer device according to claim 3, wherein the first-transfer member is provided for each of a plurality of image carriers, and wherein the alternating-current mode is selected for at least one of the first-transfer members that lastly transfers the toner image to the receiving member.

9. A transfer device comprising:

a first-transfer member that transfers a toner image formed on an outer peripheral surface of an image carrier to a receiving member;

a pressing-force-changing member that changes a pressing force applied to the image carrier by the first-transfer member;

a second-transfer power supply that includes a direct-current power supply and an alternating-current power supply; and a second-transfer member that transfers the toner image transferred to the receiving member to a medium by receiving a voltage from the second-transfer power supply, wherein the pressing force is changeable so that a different pressing force is capable of being applied during the first-transfer member transferring the toner image to the receiving member, and wherein, in response to the toner image being transferred to a medium having higher surface unevenness than predetermined reference surface unevenness, the pressing force is made smaller than in a case where the toner image is transferred to a medium having the predetermined reference surface unevenness.

10. An image forming apparatus comprising:

a toner-image-forming unit that forms a toner image on an image carrier; and the transfer device according to claim 1 that transfers the toner image to a medium.

11. The transfer device according to claim 9, wherein, if the toner image is transferred to a medium having surface unevenness greater than predetermined amount, the pressing force is made smaller than in a case where the toner image is transferred to a medium having the surface unevenness that is less than or equal to than the predetermined amount.

12. The transfer device according to claim 1, wherein the alternating current voltage is a rectangular wave voltage and has a frequency T.

13. The transfer device according to claim 12, wherein the rectangular wave voltage is a square wave.

14. The transfer device according to claim 12, wherein the amplitude of the rectangular wave voltage is one-half of Vpp, where Vpp is a difference between a maximum value and a minimum value of the rectangular-wave voltage.

15. The transfer device according to claim 14, wherein the amplitude of ½ Vpp of the alternating-current voltage to be applied to the first-transfer member is changed in accordance with a degree of surface unevenness of the medium.

16. The transfer device according to claim 14, wherein the frequency T of the alternating-current voltage to be applied to the first-transfer member is changed in accordance with a degree of surface unevenness of the medium.

17. The transfer device according to claim 16, wherein, as the degree of surface unevenness of the medium becomes higher, at least one of the following is performed: (1) the amplitude of ½ Vpp of the alternating-current voltage to be applied by the first-transfer member is made larger and (2) the frequency T of the alternating-current voltage is made shorter.

18. The transfer device according to claim 16, wherein, as the degree of surface unevenness of the medium becomes higher, the amplitude of ½ Vpp of the alternating-current voltage to be applied by the first-transfer member is made larger and the frequency T of the alternating-current voltage is made shorter.

19. A transfer device comprising:

a first-transfer member that transfers a toner image formed on an outer peripheral surface of an image carrier to a receiving member;

a pressing-force-changing member that changes a pressing force applied to the image carrier by the first-transfer member;

a second-transfer power supply that includes a direct-current power supply and an alternating-current power supply; and a second-transfer member that transfers the toner image transferred to the receiving member to a medium by receiving a voltage from the second-transfer power supply, wherein, if the toner image is transferred to a medium having higher surface unevenness than predetermined reference surface unevenness, the pressing force is made smaller than in a case where the toner image is transferred to a medium having the predetermined reference surface unevenness.

* * * * *